US011506034B1

(12) United States Patent
Dashti

(10) Patent No.: US 11,506,034 B1
(45) Date of Patent: Nov. 22, 2022

(54) METHOD FOR ENHANCING SHALLOW HEAVY OIL RESERVOIR PRODUCTION

(71) Applicant: GIFTEDNESS AND CREATIVITY COMPANY, Safat (KW)

(72) Inventor: Bashayer Dashti, Safat (KW)

(73) Assignee: GIFTEDNESS AND CREATIVITY COMPANY, Safat (KW)

( * ) Notice: Subject to any disclaimer, the term of this patent is extended or adjusted under 35 U.S.C. 154(b) by 0 days.

(21) Appl. No.: 17/409,738

(22) Filed: Aug. 23, 2021

(51) Int. Cl.
*E21B 43/24* (2006.01)

(52) U.S. Cl.
CPC ..... *E21B 43/24* (2013.01)

(58) Field of Classification Search
CPC ..... E21B 43/24
USPC ..... 166/272.3
See application file for complete search history.

(56) References Cited

U.S. PATENT DOCUMENTS 4,736,792 A * 4/1988 Brown ..... E21B 43/164 166/402
4,986,352 A * 1/1991 Alameddine ..... E21B 43/30 166/272.3
6,708,759 B2 * 3/2004 Leaute ..... E21B 43/24 166/263
9,534,483 B2 * 1/2017 Khaledi ..... E21B 43/164
10,060,239 B2 * 8/2018 To ..... E21B 43/24

* cited by examiner

*Primary Examiner* — William D Hutton, Jr.
*Assistant Examiner* — Ashish K Varma
(74) *Attorney, Agent, or Firm* — Nath, Goldberg & Meyer; Richard C. Litman

(57) ABSTRACT

The method for enhancing shallow heavy oil reservoir production is an enhanced oil recovery method for shallow heavy oil reservoirs using cyclic steam polymer injection. The method involves injecting steam into the reservoir through an injection well, shutting down the well for three months to allow the steam to soak into the reservoir, then opening the well and injecting a viscous polymer concentration of 0.7 lb/STB into the reservoir. The cycle may be repeated three times over the life of the reservoir. The heated steam reduces the viscosity of the heavy oil, and the polymer displaces the oil to the production well. The method avoids the production rate drop normally associated with steam injection. Although continuous steam injection produces a higher cumulative oil production, cyclic steam polymer injection has lower capital cost and produces a better Net Present Value (NPV).

3 Claims, 35 Drawing Sheets

Field, Oil production rate
Oil production rate [STB/d]
Date
2016
2020
2024
2028
2032
2036
2040
2044
2048
0
5000
10000
15000
20000
25000
30000
35000
40000
45000
50000
55000
60000
65000
70000
75000
80000
85000
90000
95000
100000
105000
110000
115000
120000
125000
130000
135000
140000
145000
150000
155000
160000
165000
170000
175000
180000
185000
190000
195000

Field, Oil production cumulative
Oil production cumulative [STB]
Date
0
2010
2015
2020
2025
2030
2035
2040
2045
2050
2055
2060
2065
2070
2075
2080
2085
2090
2095
2100
2105
2110
2115
2120
2125
2130
2135
2140
2145
2150
2155
2160
2165
2170
2175
2180
2185
2190
2195
2200
2205

METHOD FOR ENHANCING SHALLOW HEAVY OIL RESERVOIR PRODUCTION

BACKGROUND

1. Field

The disclosure of the present patent application relates to the extraction of oil from a reservoir, and particularly to a method for enhancing shallow heavy oil reservoir production that uses cyclic steam polymer injection to recover oil from the reservoir.

2. Description of the Related Art

Heavy oil is usually found in high-porosity high-permeability shallow unconsolidated clastic reservoirs. Heavy oil reservoirs are considered unconventional oil resources. They are challenging to develop due to their high oil viscosity. Shallow heavy oil reservoirs can be found in many places around the world, such as Canada, Venezuela, California and Texas (U.S.A), Mexico, Brazil, Indonesia, China, Alaska, and in Middle East countries like Saudi Arabia, Kuwait, and the rest of the gulf countries.

Heavy oil reservoirs usually share a general similarity in rock characteristics, fluid properties, and basic features, such as the stratigraphic entrapment mechanism, shale and carbon interbred, moderate to high viscosity, low to moderate API, relatively low pressures. Consequently, they require a high driving mechanism to displace the viscous oil to the wellbore and up to the surface. This driving mechanism is not naturally available in these types of reservoirs. Therefore, an external force must be provided to support the reservoir pressure and supply the required driving force to mobilize and push the oil from the reservoir into the well and up to the surface through the production casing. This could be accomplished by applying secondary oil recovery techniques that mimic the natural depletion forces by injecting water and/or gas through an injector well. The injected fluid would in turn displace and enhance the oil movement towards the producers. Utilizing enhanced oil recovery methods that target the residual oil saturation. $S_{or}$, through thermal, chemical, and miscible techniques is recommended for heavy oil reservoirs. Generally, for moderate to heavy oil reservoirs, thermal recovery methods work the best. Continuous steam/hot water injection efficiently decreases the heavy oil high viscosity and as a result enhances the oil displacement and recovery.

Sand production problems might arise during the life of the reservoir due to poor sand consolidation, which along with the asphaltenes deposits may complicate the process of recovering the oil if not properly cleaned and de-asphaltinized. In addition, water bearing zones encourage water flow and fingering through the less pressurized areas during production and eventually cause undesired water coning.

Well planned development and production schemes for such unconventional challenging reservoirs are always needed. Commonly, heavy oil reservoirs are developed at first under primary recovery (natural depletion) in which the only available driving mechanism is the pressure difference by means of gas cap expansion, dissolved gas expansion, and gravity drainage natural mechanisms. However, natural drive mechanisms are usually not strong enough for lifting a viscous fluid; furthermore, they in general do not last for a long period of time over the production life of the reservoir. In the case of heavy oil reservoirs, heaters are usually installed for heating the oil in order to reduce the oil viscosity. In addition, pumps are installed for the purpose of creating enough pressure differential to lift the heavy oil to the surface. Primary recovery methods mainly recover around 5% to 15% of the mobile portion of the original oil-in-place (OOIP). After which the reservoir undergoes secondary recovery methods through which the oil is displaced by water and/or gas injection. Secondary recovery techniques usually recover 20% to 35% of the mobile OOIP. Finally, the enhanced oil recovery (EOR) techniques with thermal, miscible, and chemical methods come to the picture. At this stage, the oil is recovered by decreasing the residual oil saturation, which represents the oil that was immobile prior the application of the EOR methods. EOR methods add another 15% to 20% of recovered oil. The final ultimate recovery factor of heavy oil reservoirs could be raised up to 65%.

Thermal recovery mechanisms further decrease the residual heavy oil viscosity by transferring heat to the heavy oil reservoir mainly through steam and hot water stream injections. On the other hand, polymer injection is a common chemical EOR method for heavy oil reservoirs. The viscosity of the polymer water solution should be greater than that of the heavy oil. This provides a better sweep efficiency and allows for good incremental residual oil recovery.

Many unconventional oil reservoirs exist in deep carbonate source rock and adjacent to carbonate platforms in the Cretaceous Basin on the Eastern part of the Arabian plate. Heavy oil reservoirs will play a major role for the future hydrocarbon resources in this region of the world. One such reservoir is the Gold field, which lies in northern Kuwait. Six exploratory wells that were drilled earlier have confirmed oil presence in the X-formation, which is mainly an unconsolidated sandstone reservoir. The main goal of a development plan for the Gold field is to produce a ten year plateau length with an oil production rate of 50,000 STB/D. There is a need for an enhanced oil recovery plan for achieving this goal.

Thus, a method for enhancing shallow heavy oil reservoir production solving the aforementioned problems is desired.

SUMMARY

The method for enhancing shallow heavy oil reservoir production is an enhanced oil recovery method for shallow heavy oil reservoirs using cyclic steam polymer injection. The method involves injecting steam into the reservoir through an injection well, shutting down the wells for three months to allow the steam to soak into the reservoir, then opening the well and injecting a viscous polymer concentration of 0.7 lb/STB into the reservoir. The cycle may be repeated three times over the life of the reservoir. The heated steam reduces the viscosity of the heavy oil, and the polymer displaces the oil to the production well. The method avoids the production rate drop normally associated with steam injection. Although continuous steam injection produces a higher cumulative oil production, cyclic steam polymer injection has lower capital cost and produces a better Net Present Value (NPV).

These and other features of the present subject matter will become readily apparent upon further review of the following specification.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
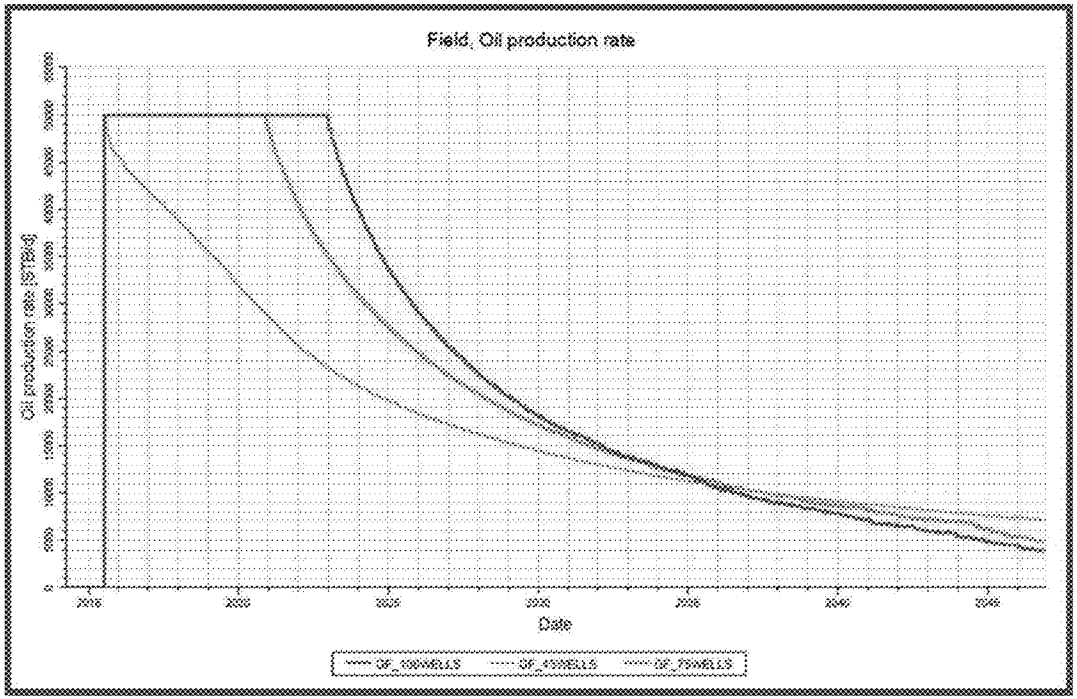
FIG. 1 is a chart comparing the total daily production produced by 45 wells, 75 wells, and 100 wells as estimated by Eclipse 100 software in a computer simulation of the base case scenario.

The method for enhancing shallow heavy oil reservoir production is an enhanced oil recovery method for shallow heavy oil reservoirs using cyclic steam polymer injection. The method involves injecting steam into the reservoir through an injection well, shutting down the well for three months to allow the steam to soak into the reservoir, then opening the well and injecting a viscous polymer concentration of 0.7 lb/STB into the reservoir. The cycle may be repeated three times over the life of the reservoir. The heated steam reduces the viscosity of the heavy oil, and the polymer displaces the oil to the production well. The method avoids the production rate drop normally associated with steam injection. Although continuous steam injection produces a higher cumulative oil production, cyclic steam polymer injection has lower capital cost and produces a better Net Present Value (NPV).

The development of the method for enhancing shallow heavy oil reservoir production is an outgrowth of a study conducted to determine the best method of developing the production of oil and gas from a region of northern Kuwait known as the Gold Field, and particularly in the X-formation reservoir of the Gold Field. The main goal of the development plan for the Gold field is to produce a ten year plateau length with an oil production rate of 50,000 STB/D (stock tank barrels/day). The development of the method is best understood in the context of this study.

A Full-Field Geocellular Model (FFGM) was constructed for the region of the Gold field. Three-dimensional (3-D) seismic data and wireline logs were used for the structural and stratigraphic interpretations, whereas petro-physical properties were obtained from six wells with open-hole logs. A Full-Field Reservoir Model (FFRM) was built to study the production performance of the field. All available engineering and well test data were analyzed and used in the construction and the calibration of the model. Forecast runs were simulated for a production target of 50,000 STB/D. Various rock and fluid parameter sensitivity runs were made to understand the uncertainty of the model forecast.

The infill well locations proposed for achieving the planned production target were selected based on the model results and are highly sensitive to all reservoir and fluid distributed properties. The model details and the well-location selection process are described below. The simulation model was built and developed using Schlumberger ECLIPSE Black Oil Model Simulator (Eclipse-100), which is a fully implicit, three-phase, and three-dimensional general purpose black oil simulator with gas condensate option. In addition, Schlumberger ECLIPSE Compositional Model was also used in order to examine and evaluate advanced heavy oil recovery techniques. These scenarios were run using Eclipse-300. A total number of nine distinct production scenarios are presented in this work, including base case, water injection, polymer injection, hot-water injection, huff-and-puff, continuous steam injection, steam polymer injection, cyclic steam polymer injection, and production via Horizontal wells. All production forecast scenarios were run in Petrel and were reviewed concurrently with the economic analysis prior to the determination of the best optimum strategy to be chosen for the development of the Gold field. The final result of the study was selection of the cyclic steam polymer injection method as proven to recover the highest oil volume with the greatest net present value (NPV).

The X-formation of the Gold Field is a stratigraphic unit of Late Early to Middle Miocene age that is recognized across much of Kuwait and Iraq. A map of the stratigraphic unit observed in northern Kuwait is shown in Alsharhan, A. S. and Narin, A. E. M. (1997). *Sedimentary Basins and Petroleum Geology of the Middle East*, Elsevier, Amsterdam. It is mainly an unconsolidated clastic reservoir that belongs to the Middle Miocene age. It forms a part of a fluvial wedge that has been deposited after the emergence of the Arabian Peninsula in the Middle Eocene Period and the tectonic uplift and tilting associated with the initial collision of the Arabian and Eurasian plates during the Oligocene Period. The X-Formation is dominated by terrigenous-clastic sediment in northern Kuwait, whereas carbonate and evaporitic rock types are observed to be more typical in Iraq. The X-reservoir is correlated with the Dammam Formation of Saudi Arabia. In Kuwait, the X-Formation conforms to and overlies the Ghar Formation and upgrades into the Dibdiba Formation. The X-formation interval is about 500 feet thick. It thins out to the south-southwest. The X-strata crops out along a southwest to northeast trend north and west of Kuwait Bay. In southern Kuwait, the unit is absent or is undifferentiated from the underlying Ghar Formation. In the subsurface of northern Kuwait, the X-Formation exhibits a well-defined and widespread internal stratigraphy. This stratigraphy is a reflection of widespread fluvial/deltaic and shallow-marine deposition, punctuated by brief episodes of marine transgression.

The formation has been traditionally subdivided into: (1) an upper shale marker bed, defining the top of the formation F0; (2) a middle shale bed, referred to as the "Cap Shale," which traditionally designates the top of the reservoir section; (3) an upper reservoir section, known as the F1 Sand; (4) a second shale bed, the "Mid Shale", separating the two main reservoir intervals; and (5) a lower reservoir section, known as the F2 Sand.

Figure 9:
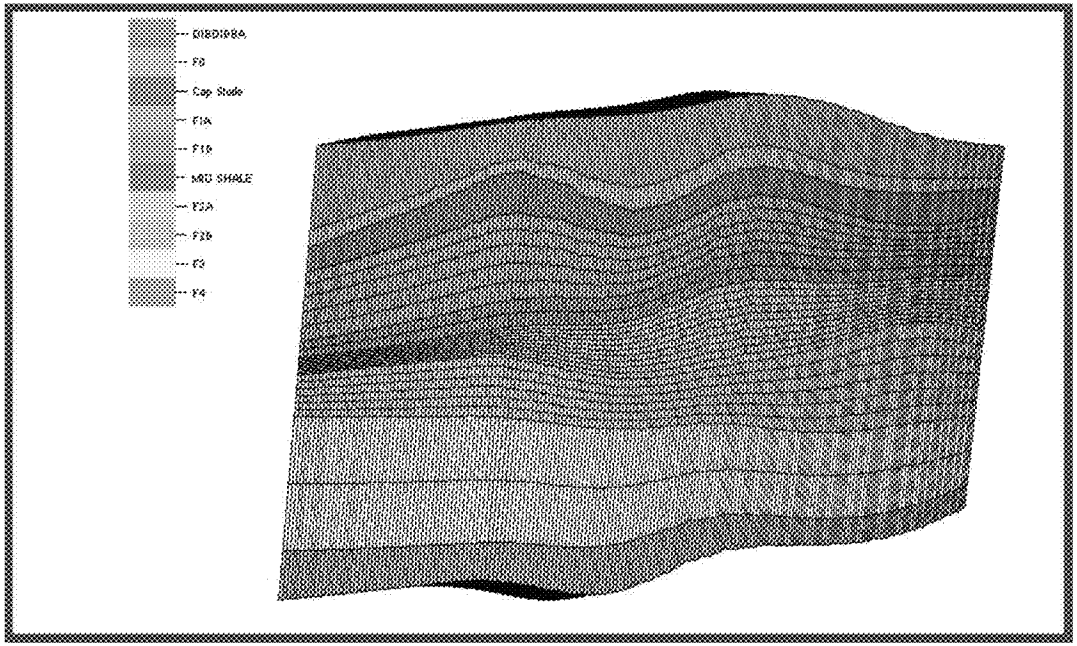
FIG. 9 is a diagram depicting the main geologic zones in the X-formation reservoir of the Gold Field in Kuwait.

In the Gold Field, the F2 sand is underlain by two additional sand-rich intervals. These are the F3 and F4 zones of good hydrocarbon potential, yet they provide less oil contribution than the overlying layers. The F1 and F2 sand reservoirs are also well developed in other adjacent areas. The Sands in F1 and F2 consist primarily of friable to poorly consolidated, moderately to well-sorted, medium to coarse grained (rarely fine) sand and common thin shale inter-beds. The sands typically exhibit some degree of cross-bedding. Patchy carbonate and gypsum cement is developed locally in the sands. FIG. 9 illustrates the X-formation reservoir zones.

Basin-ward (north-northeast), the reservoir sand bodies grade into shale and siltstone, with rare thin fossiliferous limestone beds. Despite the consistent regional stratigraphic framework, the X-reservoir intervals are characterized by significant lateral heterogeneity in petrophysical properties. This could be due to depositional changes in sand texture, localized precipitation of pore-filling cements, and variations in the thickness and frequency of discontinuous interbedded shales. In fact, the complexity in the stratigraphic entrapment mechanism made it difficult to quickly identify the distinct reservoirs in the region, but eventually, many hydrocarbon zones were detected to the top of multiple underlying water bearing zones. However, a single main tilted Oil-Water Contact (OWC) was observed at a depth of around 1400 feet beneath the main reservoir layers.

Stratigraphic correlation of the Dibdiba and Ghar Formations within the X-reservoir was performed using the six early drilled exploratory wells along with five newly drilled and cored Gold field wells. These wells were drilled along a northwest to southeast oriented line, giving essentially a two-dimensional (2-D) view of the Gold field geology. Vertical-Seismic Profiles (VSP) from the GF-0011, GF-0012, GF-0013, and GF-0014 wells provided the time-to-depth conversion. Core data collected in these drilled wells were depth shifted and tied to the wireline logs to augment correlation. Many challenges occurred in the seismic interpretation segment of the full integrated reservoir study. The X-reservoir of interest is a shallow, naturally unconsolidated, clastic reservoir with a depth ranging from 500 ft to 1200 ft. Generally, seismic sound waves respond better for consolidated reservoirs and are more accurate when reading time reflections greater than 200 MS.

Figure 10:
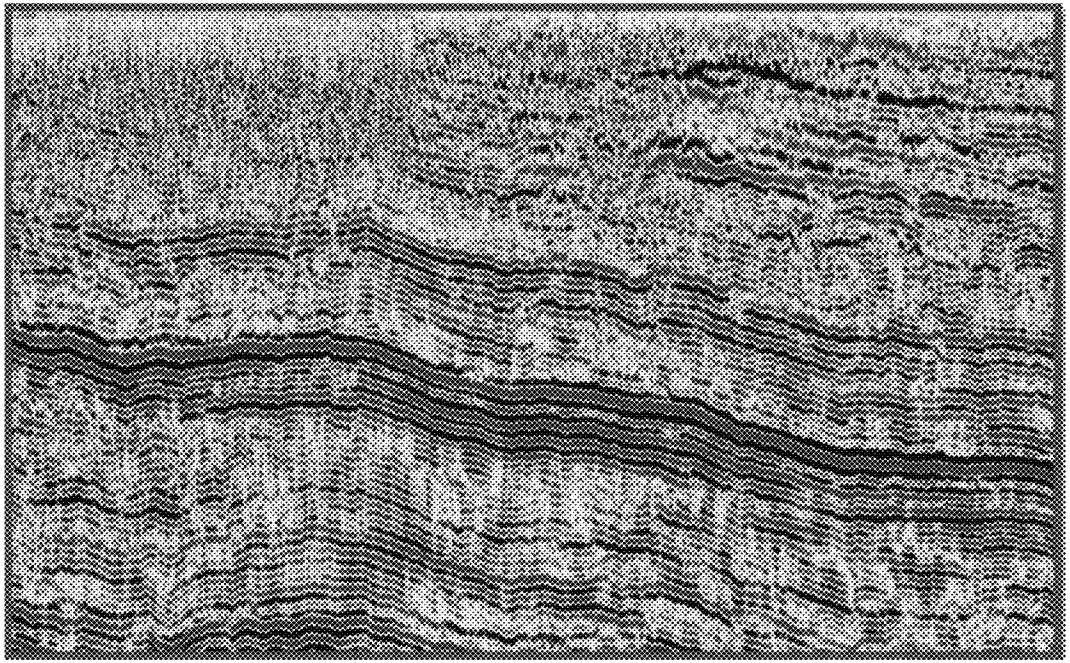
FIG. 10 is a diagram showing irregular seismic responses in the X-formation reservoir of the Gold Field in Kuwait as depicted by Kingdom software.

Hence, the seismic data for the X-reservoir in the Gold field showed an irregular, uninterpretable, and low frequency result. This made it difficult to generate an appropriate seismic mapping using the available poor seismic image quality. Therefore, integrating the seismic attribute maps with petrophysical information to qualify their correlation with geophysical response in terms of geological significance became a challenging task. The seismic results displayed in FIG. 10 are obtained from the Kingdom software.

Figure 11:
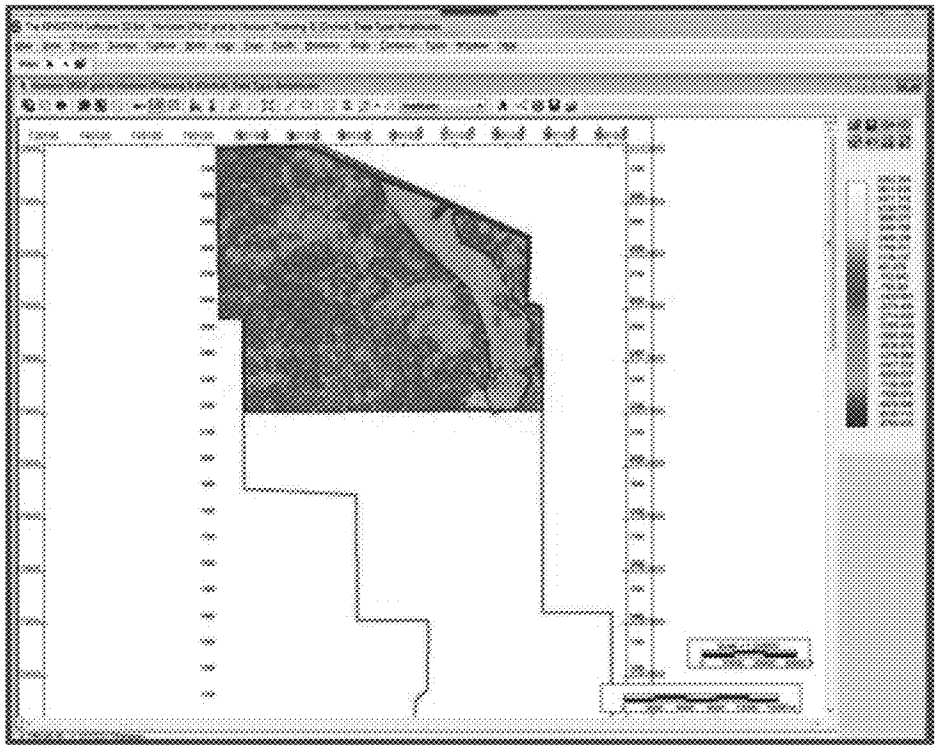
FIG. 11 is a root-mean-square amplitude map for a high amplitude anomalous seismic event in the X-formation reservoir of the Gold Field in Kuwait prepared using Kingdom software.

Correlating this event generated the Root Mean Square (RMS) amplitude map, which clearly shows the channel geometry. This map greatly contributed to identify the best oil accumulation locations. FIG. 11 displays the amplitude map as prepared using the Kingdom software. A strati-structural mechanism is the hydrocarbon trapping mechanism identified in the Gold field X-reservoir. This entrapment mechanism is composed of a combination of stratigraphic traps that account for almost 85% of the rock. The remaining 15% is structural entrapment mechanism. Thus, it is much more challenging to estimate the oil-in-place, as well as to identify the best oil accumulation locations for recovering as much oil as possible, from a mainly stratigraphic trapping reservoir.

Figure 12A:
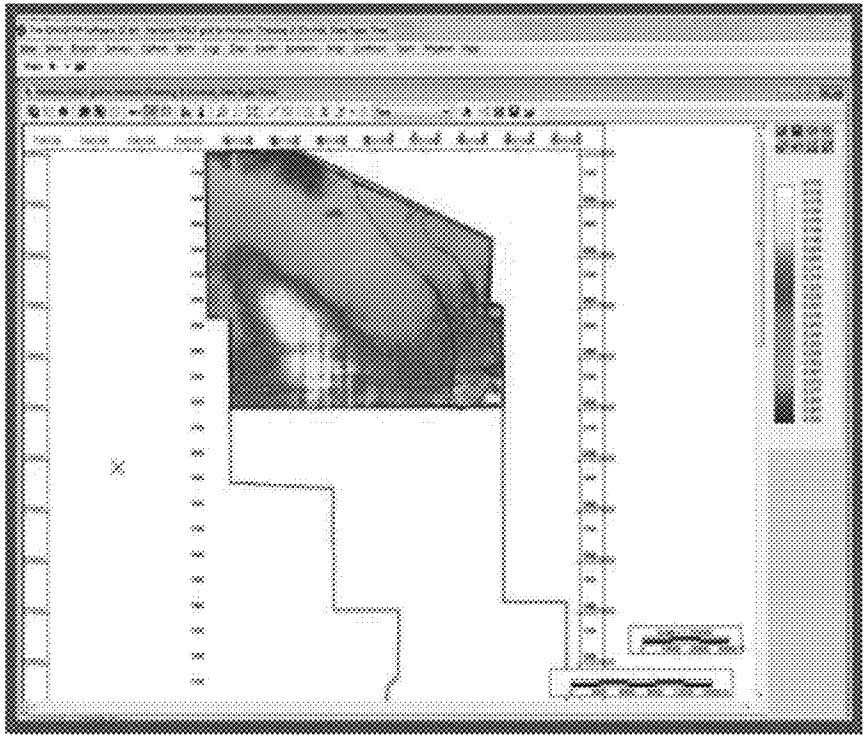
FIGS. 12A and 12B are a seismic interpretation of the X-formation reservoir of the Gold Field in Kuwait prepared using Kingdom software.
Figure 12B:
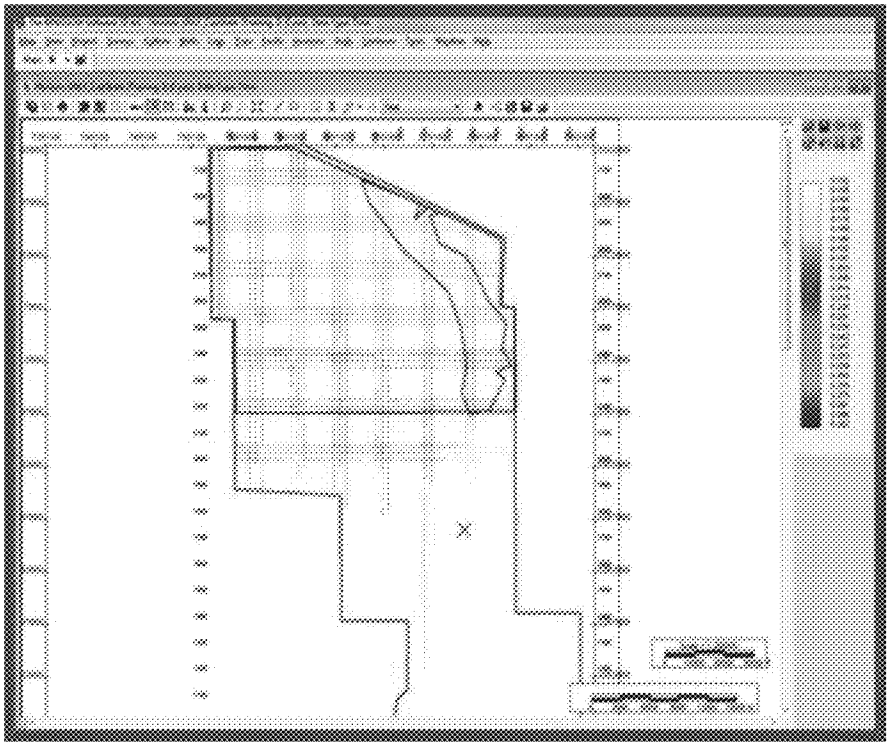

Another main challenge that may occur during the drilling phase would be well collapse due to poor sand consolidation, cementation, and packing in such a shallow reservoir. Moreover, this would cause future sand production and sand blocking problems if not handled properly and taken into consideration at early stage by adopting state-of-the-art production technologies to control the sand production and increase the oil phase flow into the wellbore. To avoid this problem, fixed meshes that act like a barrier and create little sub entrapments inside the wellbore for isolating the sand would be a proper solution to decrease sand production. To build structure surfaces, stratigraphic tops were picked and then correlated. Wireline-log correlation and seismic-data interpretation were performed concurrently. Thus, each data type provided a cross check on the 3-D seismic mapping, as shown in FIGS. 12A and 12B.

Petrophysical data was analyzed for six development wells in the Gold field prospect. These wells are given the codes GF-0011, GF-0012, GF-0013, GF-0014, GF-0015, and GF-0016. Petrophysical properties were calculated and hydrocarbon fluid distributions were estimated using wireline logs, descriptions of core lithology, and photographs of core fluorescence.

Lithology was identified in core description, including sand, shale, and shaly sand. Minor proportions of dolomite were also observed in core samples. Core photographs taken under ultraviolet light were studied for the extent and the brightness of fluorescence, with the interpretation coded from zero to one on a half-foot basis for comparison to log results. The obtained results were used to assess the accuracy of water saturation ($S_w$) calculations and interpreting fluid levels using effective porosity logs, resistivity logs, and the core photographs interpretation.

Figure 13:
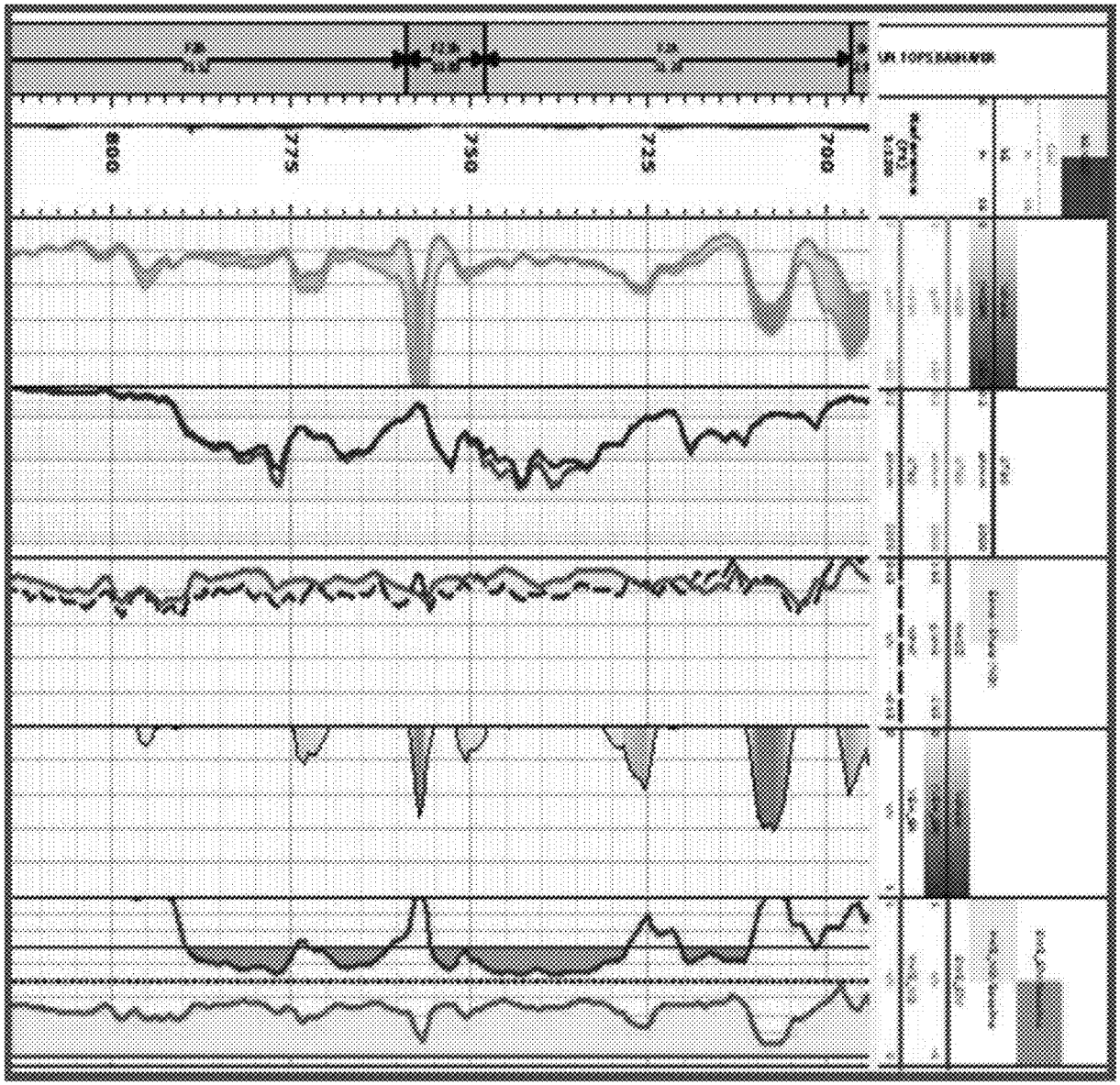
FIG. 13 is a chart showing logs of data obtained from six development wells in the Gold field of Kuwait, the logs including a caliper log, gamma ray log, resistivity log, neutron porosity log, shale volume log, water saturation log, and effective porosity log obtained from Techlog software and used to calculate petrophysical properties of the reservoir.

In the six drilled GF wells in the zone of interest, a total of 21 well-sand combinations were sampled via a wireline downhole tester. Nine of these sample depths were from the F0 sand, seven from the F1B sand, three from the F2A sand, and two from the F1A sand. The matrix lithology and the fluid type were defined according to petrophysical interpretation principles and concepts. The log reading was then used for the purpose of calculating the basic parameters, such as shale volume, water saturation, true resistivity, and effective porosity. FIG. 13 displays a few of the logs used in the calculations.

Techlog software was used to load raw logs data for interpretation. The gamma ray log (GR), resistivity logs (AT 90, 60, 30, 20, and 10, which represent deep, mid, and shallow resistivity, respectively), and porosity logs (neutron porosity and bulk density) were loaded. In the calculation of the Vshale, a rescale routine was used to set the minimum of GR over the X-reservoir interval to Vshale=0 and the median of GR over the same interval to Vshale=0.18. Then, the GR values were used to calculate the shale volume by applying the following equation:

$$V_{sh} = \frac{GR - GR_{ma}}{GR_{sh} - GR_{ma}}. \tag{1}$$

The clean sand zone and the shale concentration in the zone were adjusted accordingly to fit the Vshale log. Once the shale volume is calculated, it is used along with neutron porosity and bulk density logs for the calculation of the total and effective porosities. The density porosity was calculated from the following equation:

$$\phi_d = \frac{\rho_b - \rho_{ma}}{\rho_{ma} - \rho_f}, \tag{2}$$

where $\phi_d$=Density Porosity, fraction; $\rho_b$=Bulk Density, g/cm$^3$; $\beta_{ma}$=Matrix Density, g/cm$^3$; and $\rho_f$=Fluid Density, g/cm$^3$.

The total porosity (PHIT) was calculated from the density log (RHOB). The effective porosity (PHIE) was set equal to PHIT in sands and dolostones. PHIE was set to zero in shales. For shaly sand zones, PHIE was calculated by subtracting the clay volume from the total porosity.

The lithology line is decided as such: if $\phi_n \leq \phi_d$, choose Limestone/Sandstone combination; if $\phi_n > \phi_d$, choose Limestone/Dolomite combination.

The Neutron Porosity (NPHI) log, ($\phi_{On}$), was used to identify beds of solid shale. Wherever the neutron porosity exceeded a porosity-dependent cutoff value of approximately 0.42, the shale volume was set at 1. Dolostone lithology identified in core descriptions was added where appropriate.

Finally, the water saturation ($S_w$) log was calculated using effective porosity and resistivity log data using the following equation:

$$S_w = \left[\frac{aR_w}{R_t(\phi_e)^m}\right]^{\frac{1}{n}} \tag{3}$$

The corresponding oil saturation ($S_o$) is calculated accordingly using the following equation:

$$S_o = 1 - S_w \tag{4}$$

Figure 14:
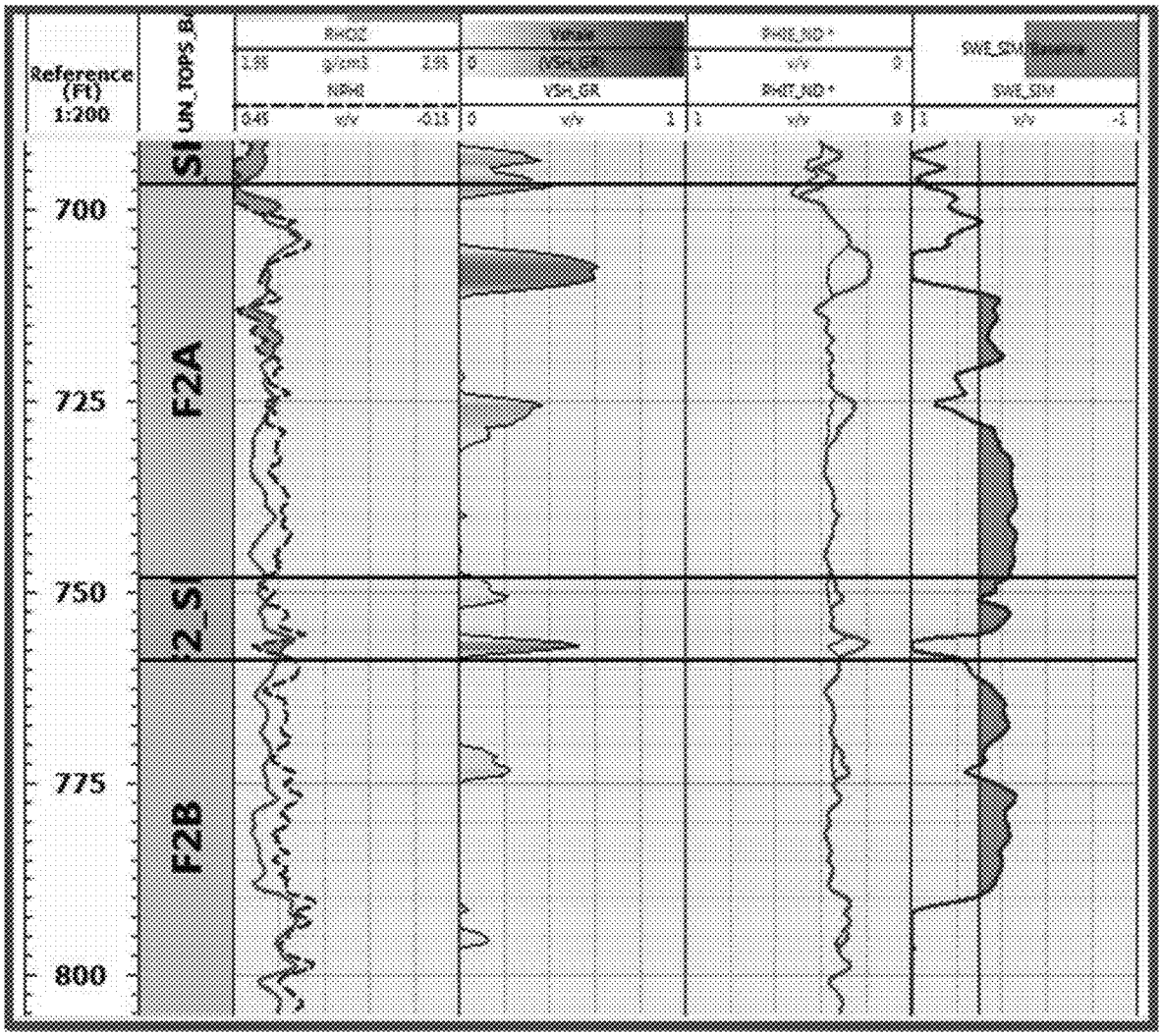
FIG. 14 is a chart showing further logs of data obtained from the six development wells in the Gold field of Kuwait, the logs including the neutron porosity log, density log, total porosity log, effective porosity log, and water saturation log obtained from Techlog software.

FIGS. 13 and 14 show the calculated water saturation log.

Figure 15:
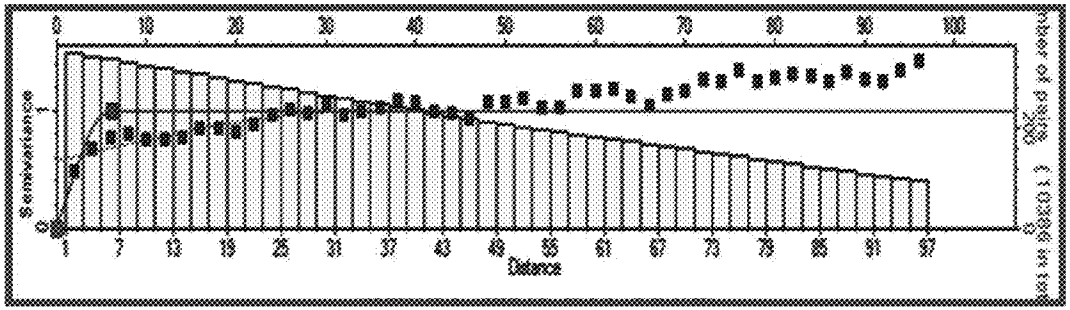
FIG. 15 is a lithofacies vertical variogram prepared from the logs of data from the six development wells used to build a Geocellular model of the Gold field reservoir.

A Geocellular model (static model) was built starting with selecting the polygon and correlating well tops to generate horizons (the stratigraphic modeling), and then moved to the structural modeling, which is horizon surface creation followed by the creation of a thickness map on the top of each reservoir member. Each zone has been divided into multiple layers for the purpose of capturing vertical reservoir heterogeneity, based on which stratigraphic zonations have been created. The data were analyzed. The log properties, such as lithofacies, porosity, and water saturation, were scaled up, distributed, checked, and then displayed into the 13 million-cells model after being analyzed through data transformation, transaction, and variogram analysis. The vertical property variogram is the basis for the Sequential Indicator Simulation (SIS) model. It displays the distance-property variance relationship statistics of a property. The transformed data and the variogram ranges were then set to distribute the properties using the proper algorithm. FIG. 15 displays the lithofacies vertical variogram. The smooth line represents the model response, whereas the decreasing stepped line exhibits the regression result.

Figure 16:
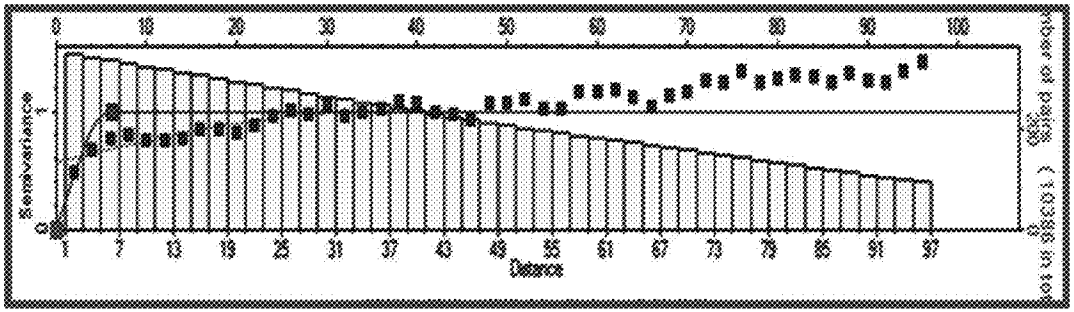
FIG. 16 is a vertical porosity variogram prepared from the logs of data from the six development wells used to build a Geocellular model of the Gold field reservoir.

The same data analysis was performed on porosity and permeability in order to better understand the distribution of these properties and become more confident about the model. FIG. 16 illustrates the vertical porosity variogram.

Sequential Indicator Simulation (SIS), guided by variograms and geologic analogs, assigned facies to the geocellular grid. The facies model was used as a template to bias and assign porosity and permeability values to the geocellular grid. Porosity was biased by lithofacies and distributed using the Arithmetic Gaussian Random Function Simulation guided by the variograms calculated for each reservoir zone. Based on the available well-test data and viscosity data of the tested intervals, effective permeability of the sand units were estimated using Darcy's law. The calculated permeability values were consistent with the core porosity-permeability relationship of an adjacent field to the X-reservoir.

No routine core analysis laboratory data were available for the Gold field. Therefore, the same relationship as previously discussed was used to construct the permeability grid in the Full Field Geocellular Model (FFGM). The permeability was then distributed using the Harmonic Gaussian Random Function Simulation. Stratigraphic surfaces from the Ghar formation top to the Dibdiba formation top were mapped seismically. These stratigraphic tops define horizons and zones in the geocellular model.

Figure 17:
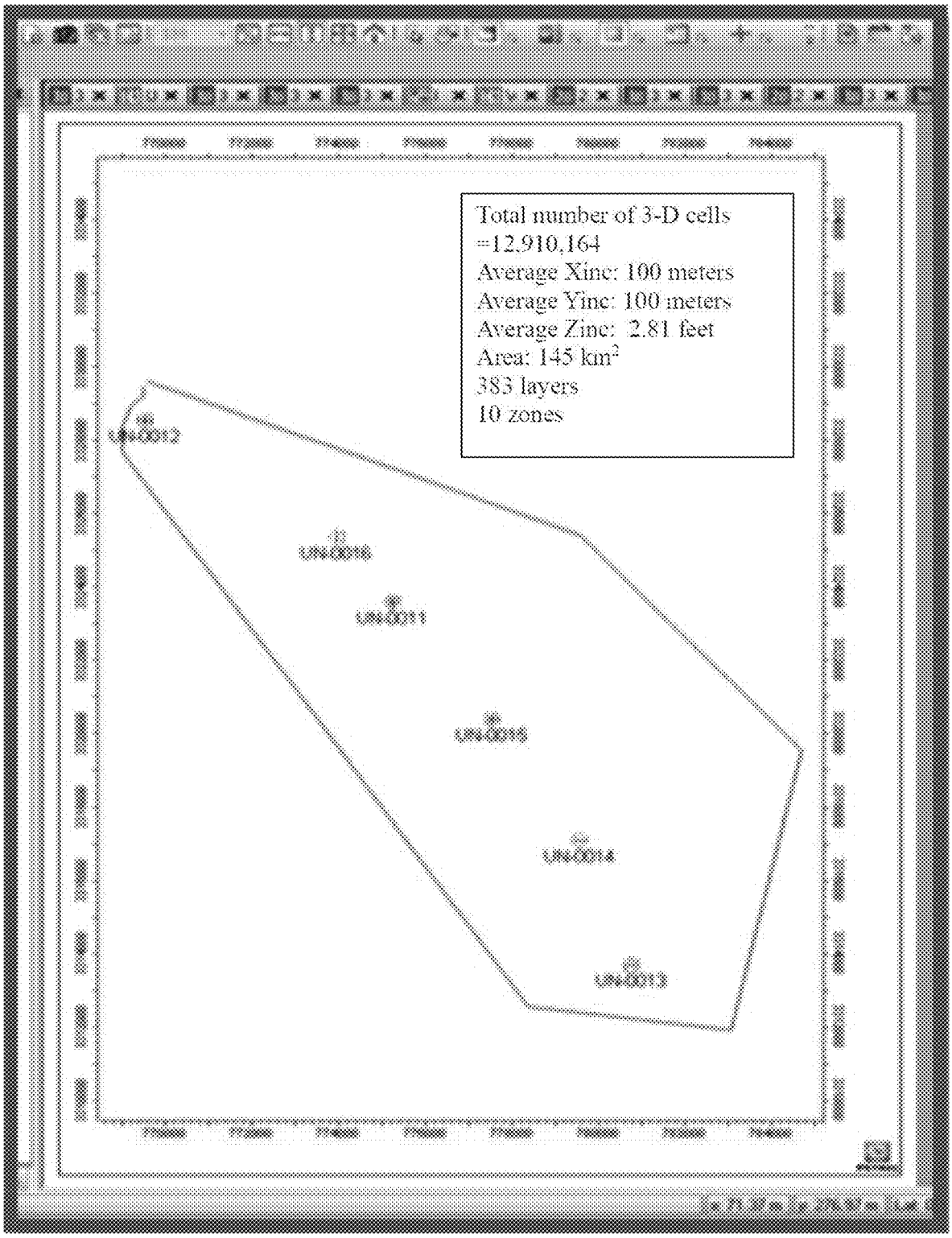
FIG. 17 is a map of the base Geocellular model the Gold field reservoir used to assess properties of the reservoir.

The FFGM grid-cell dimensions are 100 meters by 100 meters. Reservoir zones were layered proportionally to divide each zone into approximately 2.81 feet thick layers. The representation of the thickness in units of feet was done to meet the need of capturing reservoir heterogeneity precisely and to match the logs' scaling order unit for an easier correlation. Petro-physically derived facies logs were calibrated by the core data and provided the basis for building a facies model consisting of two main lithologies, shale and sandstone. Development wells were centered on the main structural high, as shown in the model base map displayed in FIG. 17.

The following data are obtained from the log interpretation performed on the Gold field in the X-reservoir.

TABLE 1

Data from log interpretation of Gold Field in X-reservoir

| Property | Value |
|---|---|
| Porosity ($\phi$) | 27% to 32% |
| Permeability (k) | 1 Darcy to 7 Darcies |
| Oil API gravity | 17 to 24 |
| Oil viscosity ($\mu_O$) | 20 cp to 100 cp |
| Initial reservoir pressure ($P_i$) | 477 psia |
| Bubble-point pressure ($P_b$) | 175 psia |

TABLE 1-continued

Data from log interpretation of Gold Field in X-reservoir

| Property | Value |
|---|---|
| Brine salinity | 23,200 mg/L to 18,700 mg/L |
| GOR | 72 SCF/STB to 130 SCF/STB |
| Net-to-gross thickness | 0.425 |

Figure 18:
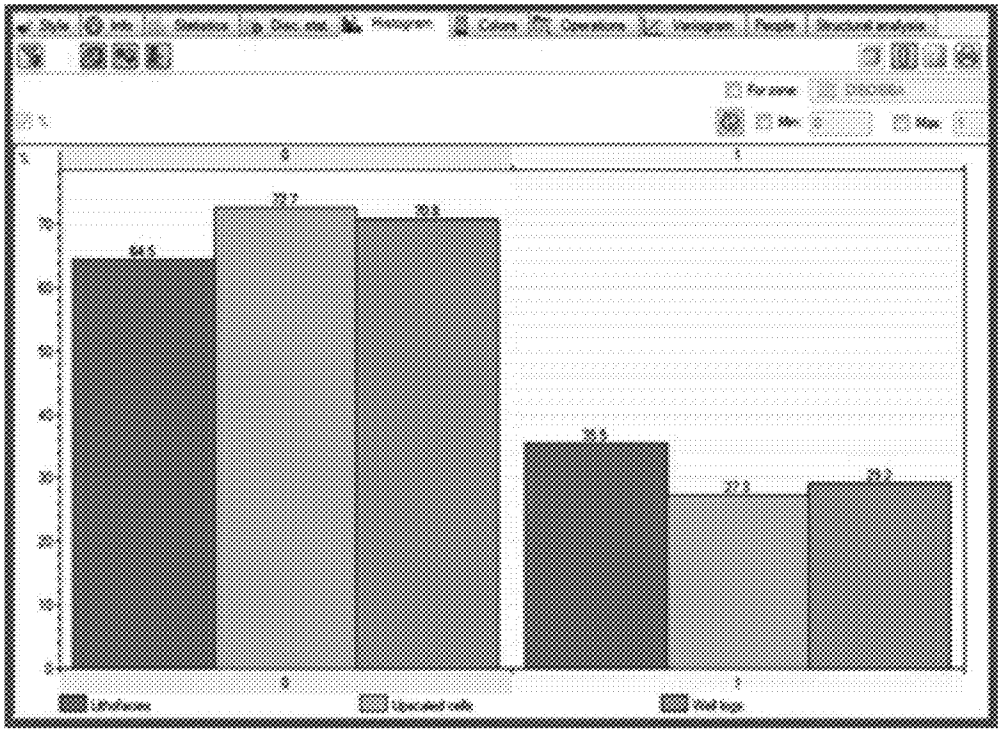
FIG. 18 are sandstone and shale lithofacies histograms before and after upscaling log data from the six development wells.

The Most of Averaging Method was used to scale up lithofacies well logs. The histogram displayed in FIG. 18 shows how frequent are the lithofacies row data to the well logs before and after upscaling for both lithofacies, shale and sandstone.

The minimum value that corresponds to the shale lithology type was assigned to zero, whereas that of the sandstone was assigned to one. The data analysis is the engine for the vertical data distribution. It shows the property proportion across the layers in a vertical direction.

Figure 19:
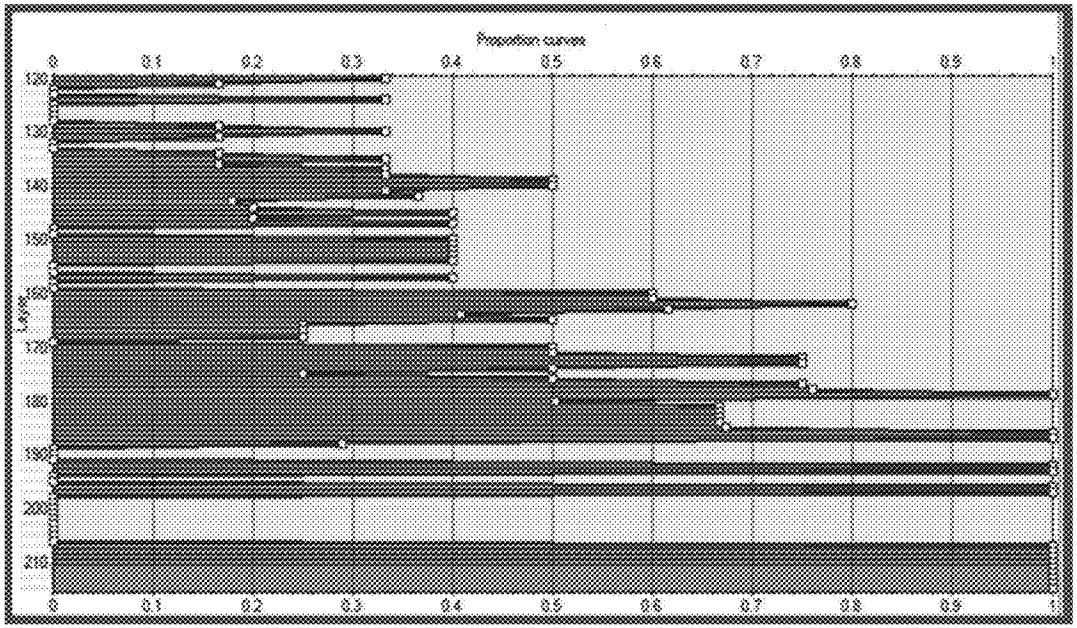
FIG. 19 is a chart showing the X-reservoir clean sand and shale vertical lithofacies proportions in the F2A layer.

The F2A zone of the X-reservoir proved to have the best lithofacies, NTG, porosity, and permeability distributions. F2A zone lithofacies proportions of sand and shale show that it has the cleanest sand among the rest of the X-reservoir zones, since some of the layers in this zone are composed entirely of pure clean sand with no shale proportions. This can be observed in FIG. 19 obtained from Petrel software, where the sand and shale proportions are assigned to each layer of the F2A zone. For each layer, the bar represents the shale proportion, the balance being the sand proportion.

Figure 20:
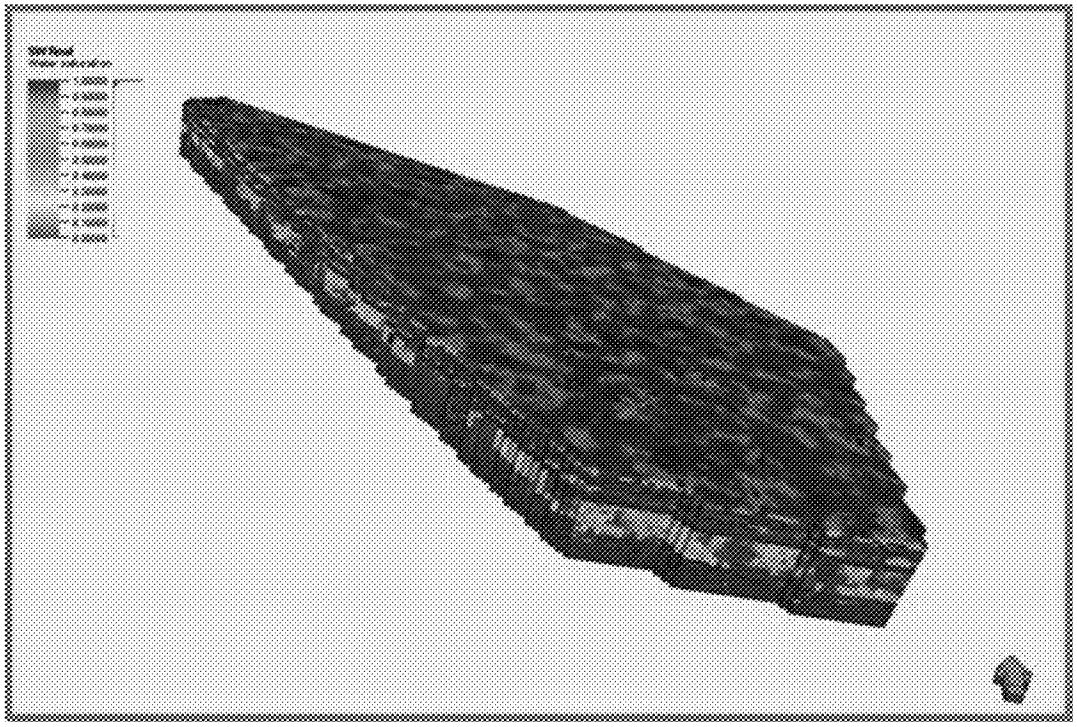
FIG. 20 is a model properties map displaying the Petrel visualization of the water saturation distribution in the different zones of the base geocellular model of the X-formation reservoir of the Gold field.
Figure 21:
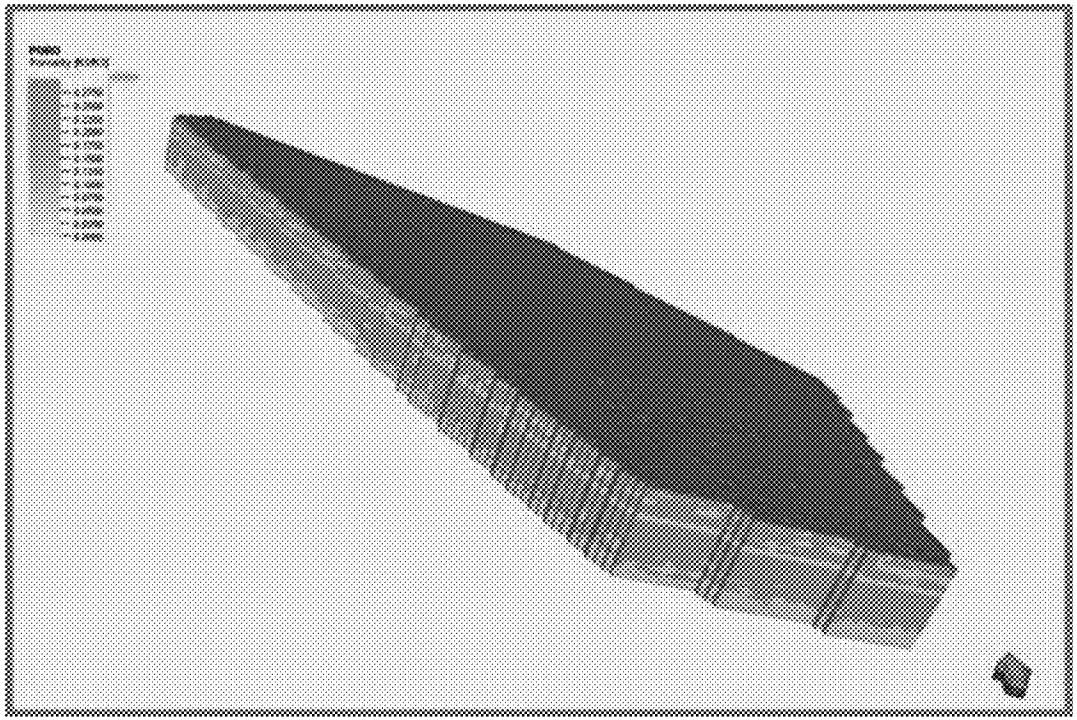
FIG. 21 is a model properties map displaying the Petrel visualization of the porosity distribution in the different zones of the base geocellular model of the X-formation reservoir of the Gold field.
Figure 22:
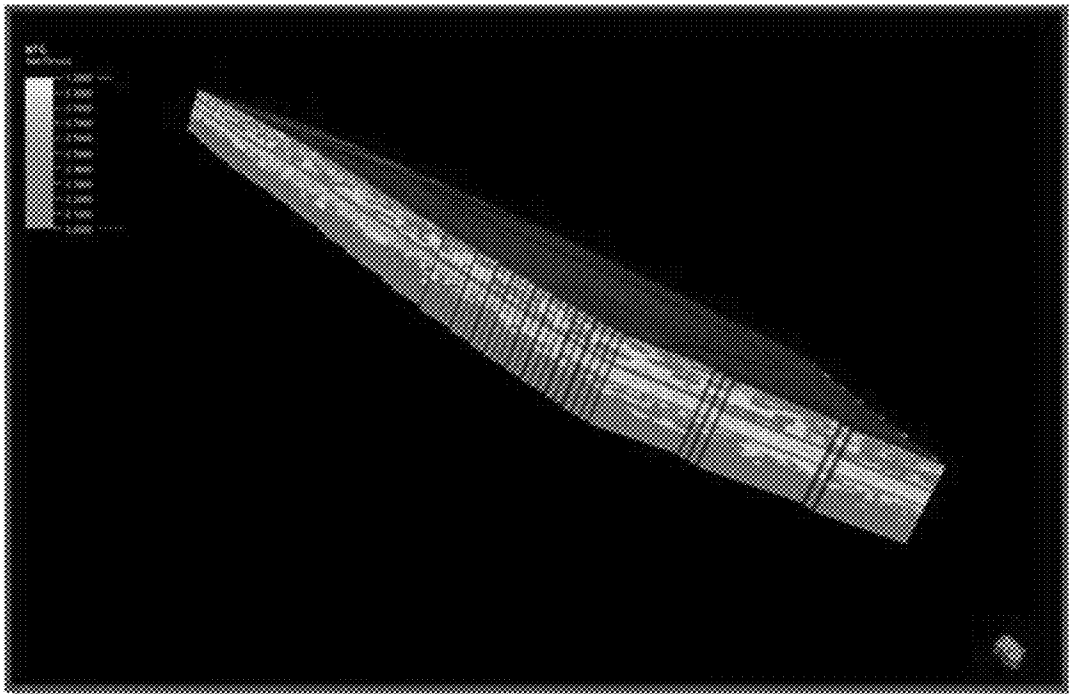
FIG. 22 is a model properties map displaying the Petrel visualization of the NTG distribution in the different zones of the base geocellular model of the X-formation reservoir of the Gold field.

Model property maps were generated in Petrel on the basis of the model static parameters. FIGS. 20 through 22 display the water saturation, the porosity, and the NTG grid distributions of each layer contained in the X-reservoir different zones, respectively.

The simulation model was created from the three-dimensional geocellular fine grid model. In-place volumes were estimated and finally started generating various scenarios, such as base case, infill drilling, water injection, polymer injection, thermal steam flood, mixed stream injection, and horizontal wells. When possible, all these scenarios are executed under Field Oil Production Rate (FOPR) constraint of 50,000 STB/day for a period of 10 years, at least. Planning to carry on with production forecast for various development scenarios for the Gold Field, an EOR method is needed in the future life of the reservoir for the purpose of recovering as much oil as possible by decreasing the residual oil saturation ($S_{or}$).

The Gold field X-formation FFGM was upscaled vertically to generate the Full Field Reservoir Model (FFRM) for the purpose of capturing reservoir heterogeneity and minimizing the required computational time. Normally, upscaling would consider a distinct average value of each grid cell property. The areal cell size in the upscaled model is 100 meters by 100 meters with an average vertical thickness of about 29.13 ft. The total number of cells was reduced from 12.9 million cells in the original FFGM to around 977,532 cells in the FFRM. The FFGM dimensions were 100 meters by 100 meters in the x and y-directions, respectively, with an average thickness of 2.81.

Figure 23:
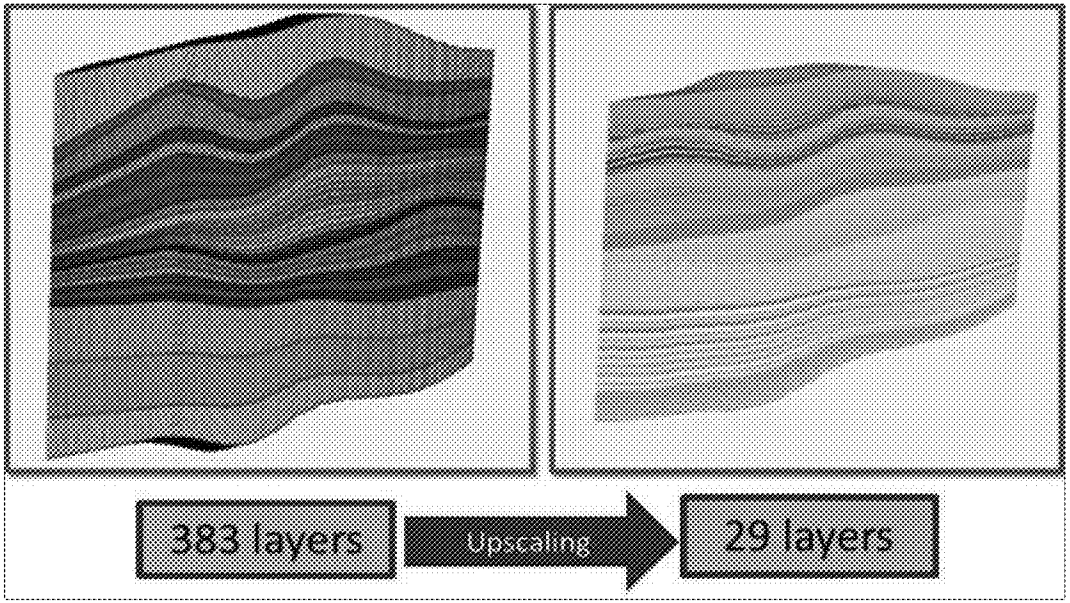
FIG. 23 a table of grid model properties after vertical upscaling in a Full Field Reservoir Model to capture reservoir heterogeneity while minimizing computational time in assessing the effectiveness of enhanced oil recovery methods for developing the Gold field reservoir in Kuwait.
Figure 24:
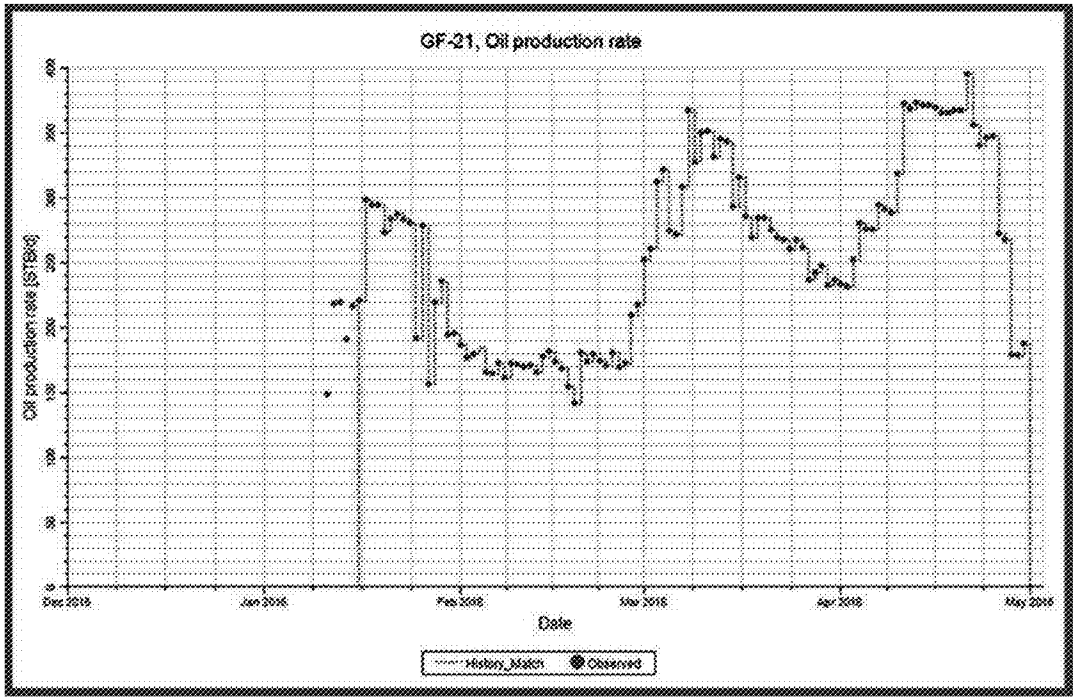
FIG. 24 is a plot comparing history match of the actual flow rate data of well GF-0021 with the data generated by a model simulating the flow rate over a three-month period.
Figure 25:
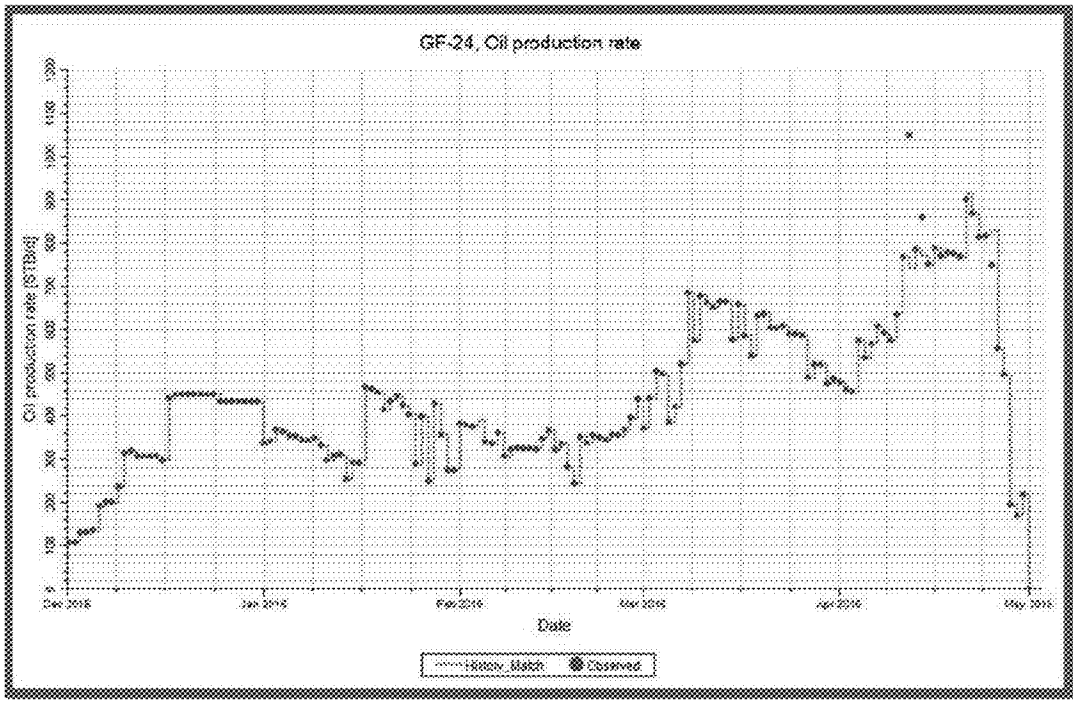
FIG. 25 is a plot comparing history match of the actual flow rate data of well GF-0024 with the data generated by a model simulating the flow rate over a five-month period.
Figure 26:
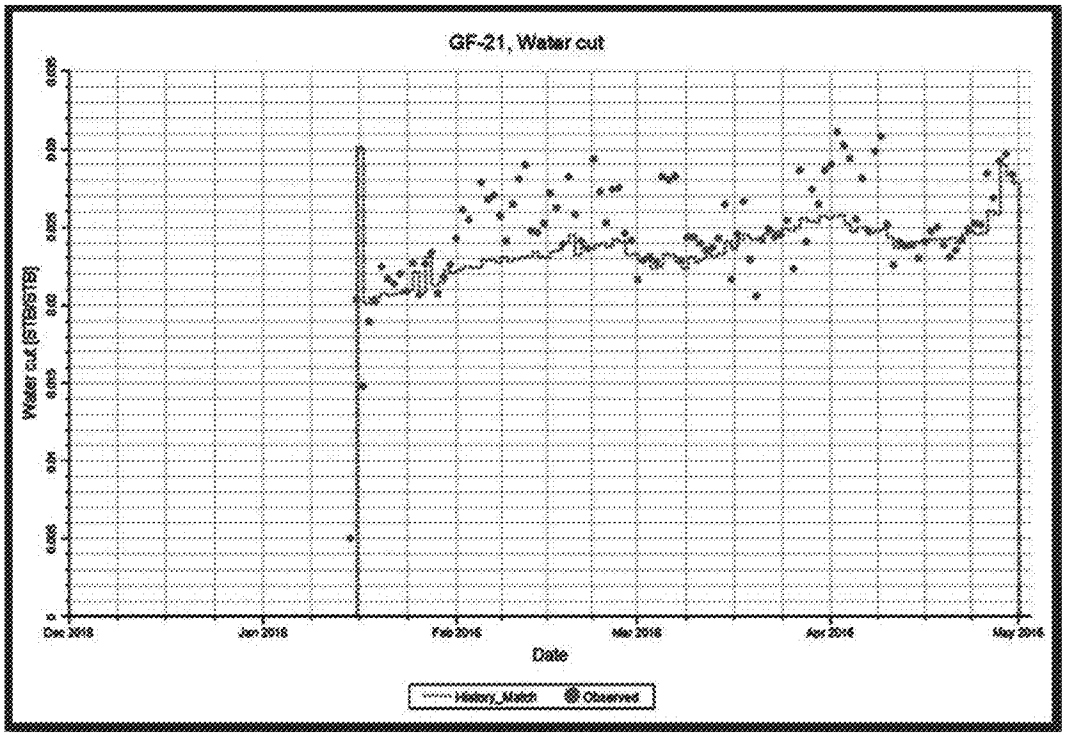
FIG. 26 is a plot comparing history match of the actual water cut data of well GF-0021 with the data generated by a model simulating the water cut over a three-month period.
Figure 27:
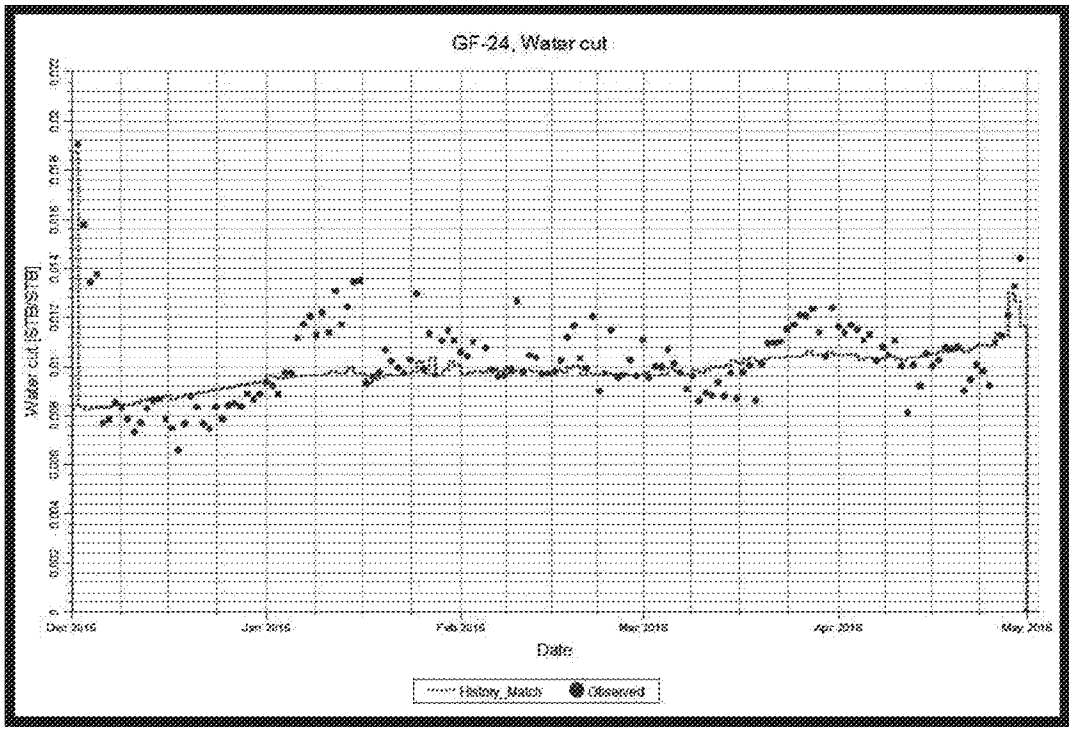
FIG. 27 is a plot comparing history match of the actual water cut data of well GF-0024 with the data generated by a model simulating the water cut over a five-month period.
Figure 28:
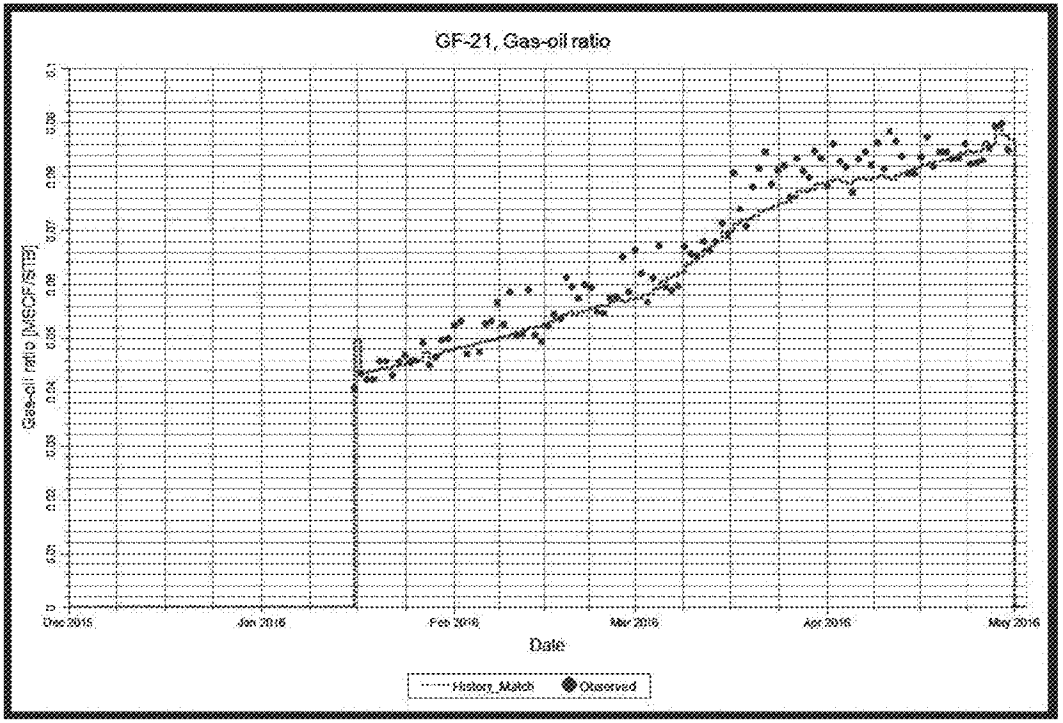
FIG. 28 is a plot comparing history match of the actual gas/oil ratio data of well GF-0021 with the data generated by a model simulating the gas/oil ratio over a three-month period.
Figure 29:
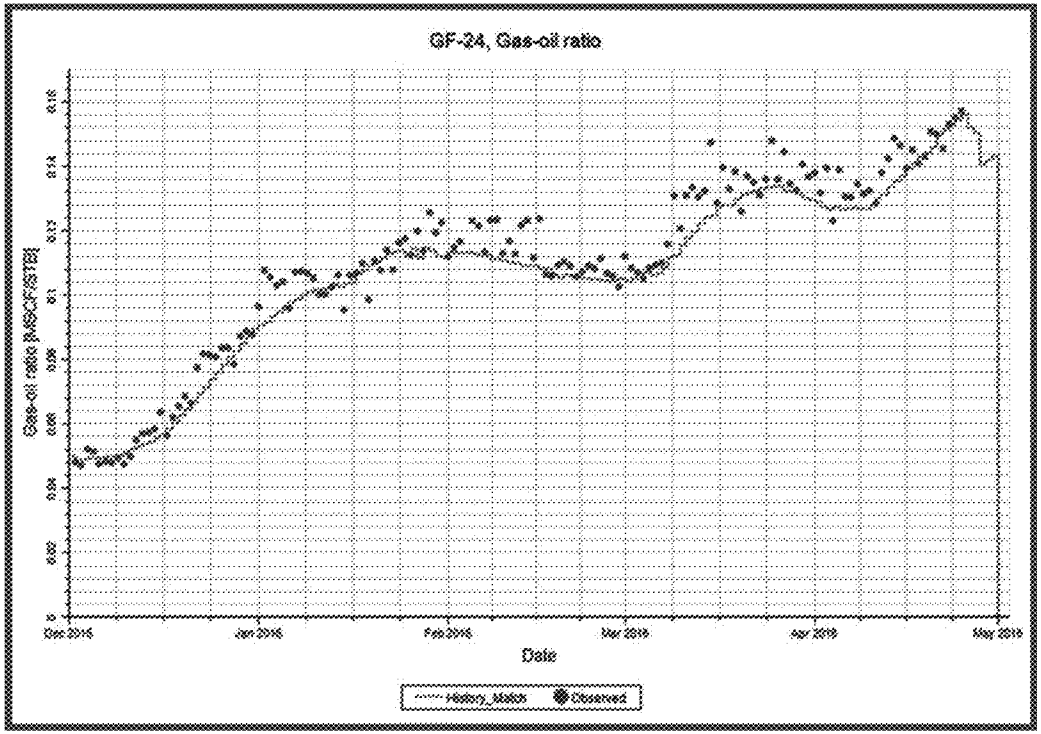
FIG. 29 is a plot comparing history match of the actual gas/oil ratio data of well GF-0024 with the data generated by a model simulating the gas/oil ratio over a five-month period.

Upscaling is mostly done vertically because reservoirs are usually more heterogeneous vertically rather than horizontally, i.e., through sand and shale sequences. Thus, vertical upscaling is preferred, since it provides a better foot-by-foot coverage, rather than an areal (x, y) upscaling of 100 meters by 100 meters, which is already scaled big enough, compared to 1 ft. in the geocellular model. In addition, a large enough number of cells (4-10) is needed between wells for generating a better simulation of fluid flow and transmissibility between wells for the different forecasting scenarios. For this reason, the upscaling was not done areal wise. Finally, there is no need of fine 1 ft. layers within shale zones and within high quality sandstone zones; consequently, all the homogeneous layers were merged together. The final simulation model with a total number of 29 layers was good enough to capture the heterogeneity and to decrease the Central Processing Unit (CPU) run time consumed by each run. FIG. 23, taken from Petrel software, shows a comparison between the 383 layers of the original model and the 29 layers of the upscaled model.

The initial oil-in-place (IOIP) was also affected by the upscaling process. The IOIP had dropped slightly from 4,146 MMSTB in the static model to around 3,962 MMSTB in the upscaled and initialized dynamic model.

The FFRM was calibrated using all available well test data from four wells (GF-0011, GF-0012, GF-0013, and GF-0015). During simulation, the FFRM matched the production rates without any major modifications. Well productivity multipliers were required to match the production rates in carbonate layers, which were consistent with the acid fracture workovers in those intervals.

Forecasting runs were conducted on the FFRM with a targeted maximum field oil-production rate of 50,000 STB/D. Six existing wells along with 45 additional wells were used for the forecast, followed by a 75-wells scenario and ending with a 100-wells scenario. All oil-bearing layers were perforated and produced with a maximum oil production rate of 1,000 STB/D per well, except for the thermal recovery generated scenarios where the desired well production rate constraint was up to 2,000 STB/D. A minimum bottomhole pressure limit of 50 psi was applied to all wells.

History matching is the step through which a quality check is performed on the model work. It is an essential step in the full integrated reservoir study for validating the entire work. A validated model is a model that can be used for predicting future field performance. This validation step is performed by comparing the historical real field data to the simulated data and observing how identical or different they are. Once the real field data are in good match with the corresponding simulated data, we become confident that the simulation model can be efficiently used to predict future production and to simulate reservoir performance under various development scenarios. The anticipated optimum scenario should yield the longest production plateau and should be economically feasible. The Gold Field is an exploratory field which has no historical real field data to match. Yet, the model still needs to be evaluated and checked quality-wise.

Newly drilled wells that are recently put on cold production were added to the generated dynamic model through inducing their corresponding x- and y-coordinates. Model validation has been conducted by comparing the field real data production of each and every one of the wells that have been induced in the simulation model to the results obtained from the production plots generated from the office results section in the Eclipse software.

Overlapping production curves mean that the model perfectly represents the simulated field. Curves with a tight distance between them could also reflect a good match between the simulation model results and the real field data. Once a good match is accomplished between the real field production data and the simulation production data, the model is said to be validated, and the process can be carried out further through generating reservoir future performance prediction scenarios.

The collected field data were scrutinized. Erratic points were excluded and filtered prior to being inserted in the model for running a history match analysis. The history match analysis was designed on the basis of the oil flow rate. FIGS. 24 through 29 show how the oil flow rate, the water cut, and the gas oil ratio model data match the real field data of the five recently added wells.

The best well locations and optimum number of wells that satisfy the production objective can be determined by integrating hydrocarbon volume, pressure and mobility maps into desired well design and locations. Porosity, permeability, oil saturation, pressure, and thickness distributions were taken into consideration for determining the best well locations. Based on several well-location-sensitivity runs using the FFRM, 45 infill well locations were selected for achieving the cold oil production plateau target of 50,000 STB/D. An additional six well locations were also selected in case of surface constraints or other logistical issues.

Choosing the best well location in a complicated system is not an easy task, especially in case of interference between hydrocarbon and water bearing zones. This is because water-bearing sands are mostly separated from oil-bearing sands by shale barriers. Well sweet spots should be wisely chosen according to principal properties distribution within the reservoir dynamic model. These properties are porosity, permeability, oil saturation, and reservoir pressure.

The traditional approach in locating the wells is by examining each X, Y, and Z model laterals and observing the best grid locations of the main affecting properties, such as porosity, oil saturation, reservoir pressure, permeability, and net thickness. Also, the five-spot, seven-spot, and line drive well patterns are widely used for structural reservoirs with a good level of homogeneity. However, this approach is time-consuming, tedious, and could lead to wrong estimates of the OOIP, especially when the reservoir trapping mechanism is of a complex stratigraphic type.

Many scenarios were generated for allocating the wells until the best proposal was reached using the following equation:

$$ONT = NTG * \phi * S_o * H. \quad (5)$$

In the above equation, the net-to-gross ratio, NTG, accounts for the laterals that contribute to oil production among all laterals. The porosity, $\phi$, was added to consider the cells with good porosity and, accordingly, good permeability. The oil saturation, $S_o$, represents grid cells having good oil potential, hence, better oil production. Finally, multiplying the above product, ($NTG*\phi*S_o$), by the total thickness, H, to account for all existing reservoir layers yields a mathematical equation that assigns a net oil zone thickness (ONT) value for each model grid cell. The above equation would enhance oil production due to better selection for the well locations.

Equation 5 takes into consideration all important factors that affect the selection of a well's best spot. Hence, choosing well locations in this manner has become much more logical and results in a better improvement of oil production. Equation 5 provides a focused, reliable, easy, and quick tool for locating the wells in the best effective dynamic model spots.

Figure 30:
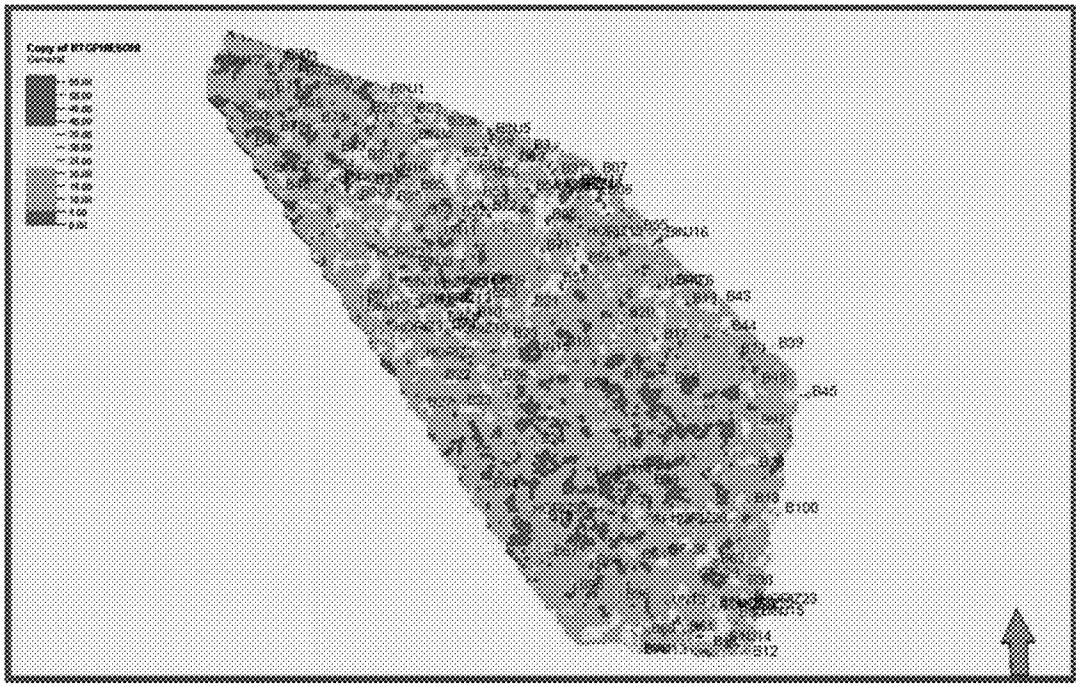
FIG. 30 is a map showing a Petrel visualization of the ONT (net oil zone thickness) distribution on the Full Field Reservoir Model of the Gold Field in Kuwait.

Once the property is developed and distributed throughout the grid model, Petrel software enables calculating the average property for the total reservoir thickness. The sum vertically option in Petrel must be activated in order to account for the rest of the reservoir layers. The generated property map illustrated in FIG. 30 can be used to locate the wells in the best contributing grid cells.

Model runs showed that the oil viscosity and the sand connectivity parameters have a significant effect on well performance. In addition, maximum injection rates of pressure and temperature were also found to have a significant impact on field performance and total amount of recoverable oil. The larger the field area covered by the drilled wells, the longer the targeted production plateau is sustained, and hence, greater oil recovery is achieved. This approach is more efficient than locating all wells in the high net area only.

Since the reservoir fluid type is heavy black oil, most of the prediction scenarios were created using a simple black oil model that works adequately using uploaded PVT tables. The Base Case, Water Injection, Polymer Injection, and Hot Water Injection prediction scenarios were designed using Black Oil Model, which was generated using Eclipse 100.

In order to examine and visualize thermal recovery techniques that consist of inducing heat into the designed scenario, a compositional model of the project had to be created. Initial condition PVT data were applied to calculate the Equation of State (EOS). Pressure and saturation values were calculated using the thermal simulation model for each component in each cell of the model. The simulated results included about thirty-one components, which were then reduced to around six components by grouping. Thermal properties that change with respect to temperature were re-evaluated in the properties section (PROP) of the model. The EOS in the compositional model basically tracks the change in the composition of the different reservoir fluid phases. A compositional model is created using Eclipse 300.

Huff-and-Puff and continuous steam injection scenarios were calibrated using the thermal compositional model. A mixed stimulation simulation scenario that starts with injecting a continuous hot water stream into the formation followed by the injection of a proper polymer type and a reversed mixed scenario of the same kind were designed for increasing the formation production rate. The mixed scenarios were generated in the Black Oil Model and run using Eclipse 100.

Various forecast development strategies were generated for achieving the target production rate of 50,000 STB/D. Sensitivity analysis was performed on major factors, such as well location, well spacing (total number of production wells), well type, field production constraints of pressure and rate, secondary recovery workovers, and tertiary recovery methods for the purpose of defining and adopting the field optimum production strategy.

Figure 31:
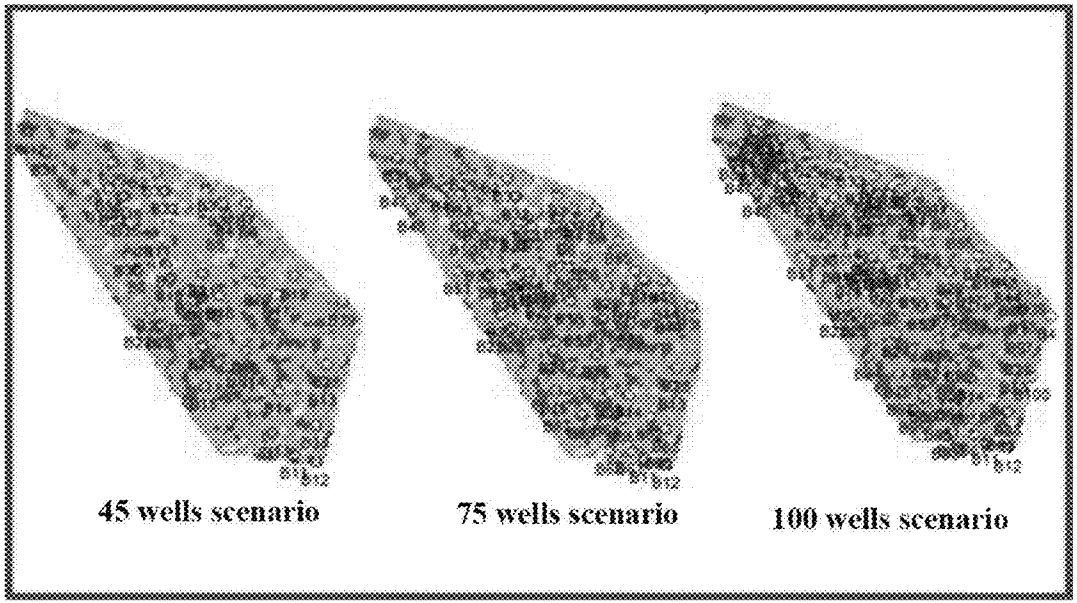
FIG. 31 is a set of maps for a base case scenario showing the optimal locations of wells for 45 total wells, 75 total wells, and 100 total wells, respectively, while assessing the effectiveness of enhanced oil recovery techniques in developing the Gold Field reservoir in Kuwait.

Scenarios on different total number of wells have been developed, starting with 45 wells to 75 wells, and ending with 100 production vertical wells. Three horizontal wells were added later to enhance the oil recovery. A water injection method has also been examined, where water was injected for enhancing the oil production rate. Finally, tertiary recovery of cyclic steam injection (huff-and-puff), continuous steam injection, and polymer injection methods were applied for a better sweep efficiency, and hence, better oil recovery. FIG. 31 shows the best spots occupied by producers and injectors in the different number of wells scenarios. The sweet spots are the spots that have the most encouraging values of the fluid and the rock properties.

Different enhanced oil recovery (EOR) scenarios are represented as follows. A brief description of each scenario is presented. The total daily oil production rates and cumulative oil production obtained from the simulation runs of each scenario are plotted and compared with each other.

Example 1

Base Case Scenario

The base case consists of designing the production prediction scenarios without applying any stimulation approaches or using external forces that could maintain the reservoir pressure and enhance the oil recovery. The base case is based on just using different numbers of production wells. The Black Oil Model run in Eclipse 100 was used to generate the results.

Evidently, the greater the number of production wells, the higher is the daily oil production. FIG. 1 indicates that the total daily production from 45 wells is 45,000 STB/D, which is lower than the targeted daily production rate of 50,000 STB/D. The total daily production from 75 wells is 50,000 STB/D, sustained for a plateau length of around 5 years, after which the production starts declining smoothly. The total daily production from 100 wells is 50,000 STB/D, sustained for around 7.5 years.

Figure 2:
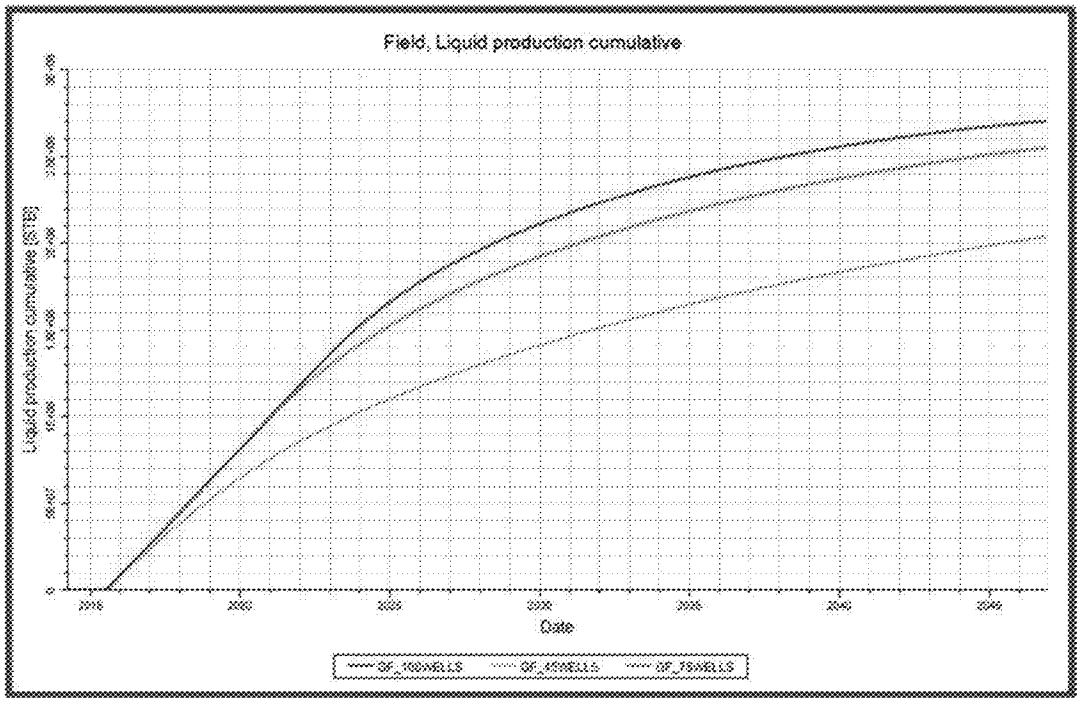
FIG. 2 is a chart comparing the cumulative oil production as a function of time for 45 wells, 75 wells, and 100 wells as estimated by Eclipse 100 software in a computer simulation of the base case scenario.

FIG. 2 displays the cumulative oil production from all three cases. It is evident that the cumulative oil production increases as the total number of production wells increases. The cumulative oil production obtained from the 45 wells, 75 wells, and 100 wells after 30 years of production is 204 MMSTB, 255 MMSTB, and 271 MMSTB, respectively. The abandonment production rate is 15 bbl/day, whereas the abandonment pressure was set to 50 psi.

Example 2

Water Injection Scenario

Water injection as a secondary recovery method was conducted on the base case scenario for the three different total number of production wells. 13 injection wells were located with an optimized water injection rate of 2000 bbl/D per well. The selection of the total number of injectors and the water injection rate were specified for the purpose of enhancing oil production, delaying water breakthrough time, and limiting pressure decline rate. The water injection process started from day one of the project production forecast. The produced water has been re-injected, as this process would reduce the total cost.

It is noticeable that the water injection method has maintained the targeted oil production rate of 50,000 STB/D for a longer production plateau length than the base case. Additional periods of 6 years and 9 years over the base case scenario were sustained for the 75 wells and 100 wells cases, respectively. The water injection process resulted in an incremental production plateau length of one year and 1.5 year for each of the 75 wells and the 100 wells cases, respectively, when compared to the base case scenario.

Figure 3:
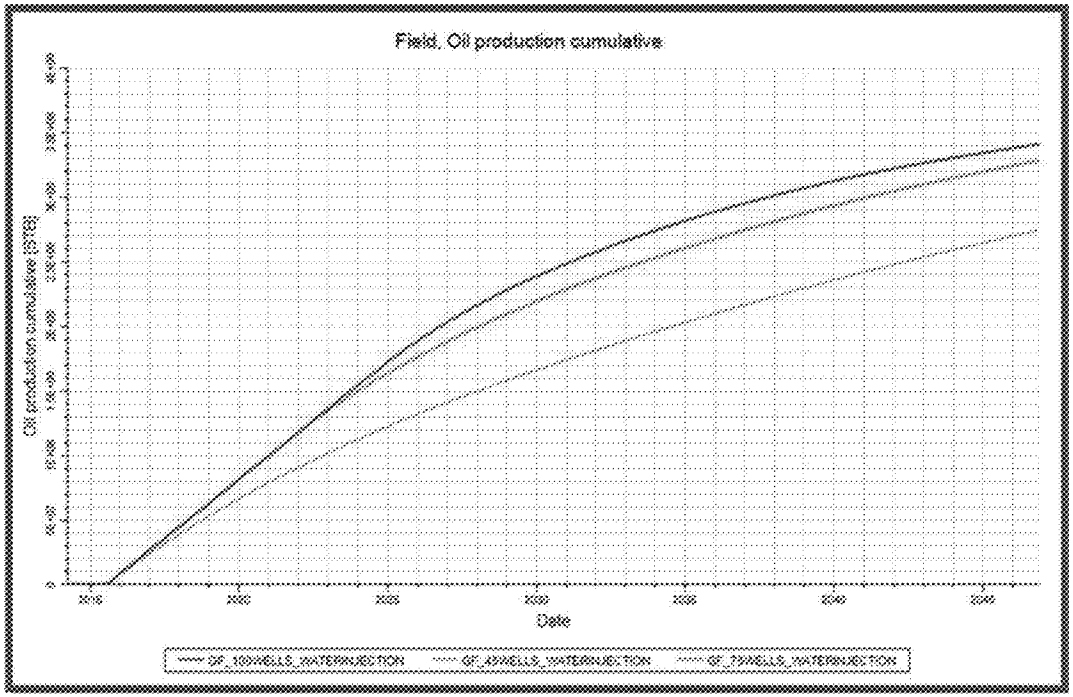
FIG. 3 is a chart comparing the cumulative oil production as a function of time for 45 wells, 75 wells, and 100 wells as estimated by Eclipse 100 software in a computer simulation of the water injection scenario.

The corresponding cumulative oil production obtained from the 45 wells is 275 MMSTB, 328 MMSTB from the 75 wells, and 341 MMSTB from the 100 wells, as shown in the cumulative oil production rate plot illustrated in FIG. 3. Again, the simulation runs of all cases were terminated at the end of year 2045. The water injection scenario was developed using the Black Oil Model and run in Eclipse 100.

Example 3

Polymer Injection Scenario

A continuous stream of polymer of a concentration of 0.7 lb/STB and a viscosity of 280 cp was injected into the reservoir at a rate of 2,000 bbl/D for a better oil sweep efficiency. The targeted production rate plateau of 50,000 STB/D was sustained for 8 years and 11.5 years for the 75 wells and 100 wells cases, respectively. The polymer injection scenario yielded an incremental production plateau length of 2 years and 2.5 years over the plain water injection scenario for the 75 wells and the 100 wells, respectively.

Figure 4:
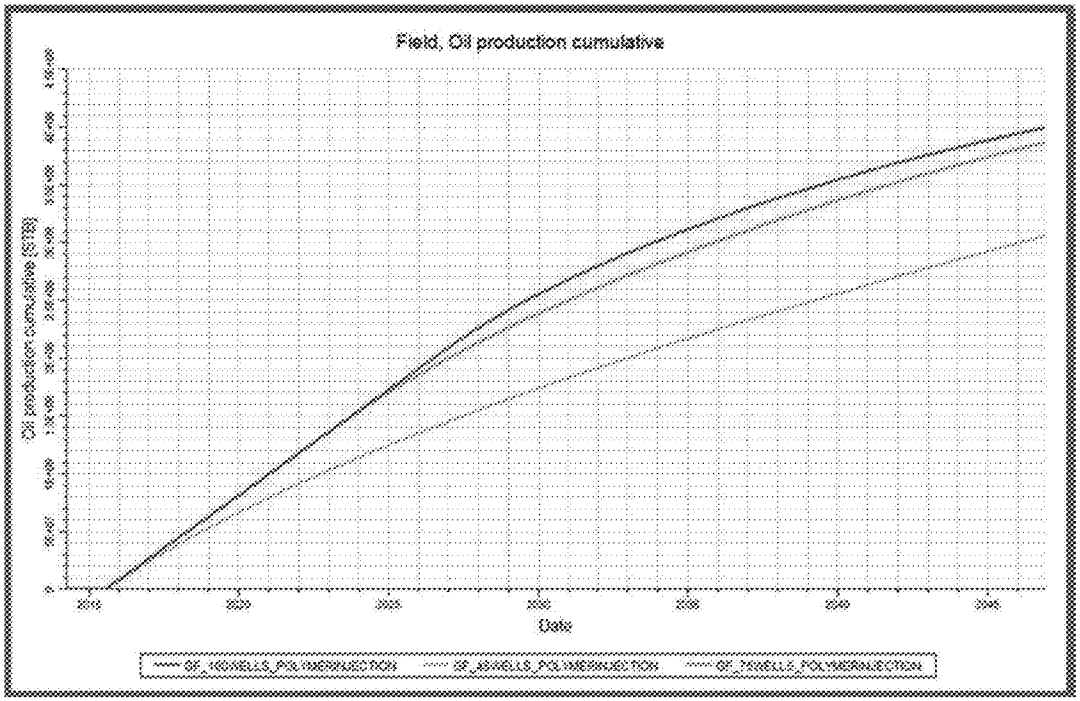
FIG. 4 is a chart comparing the cumulative oil production as a function of time for 45 wells, 75 wells, and 100 wells as estimated by Eclipse 100 software in a computer simulation of the polymer injection scenario.

Similarly, the cumulative oil production is increased corresponding to increasing the total number of production wells. The cumulative oil production obtained from the 45 wells, 75 wells, and 100 wells is 305 MMSTB, 386 MMSTB, and 400 MMSTB, respectively. FIG. 4 displays the cumulative production of this scenario. This Figure indicates that the cumulative oil production resulted from drilling 75 production wells is close to that obtained from the 100 production wells scenario, with an approximately 15 MMSTB difference.

Example 4

Hot Water Injection Scenario

The hot water injection scenario is somewhat similar to the normal water injection approach. In this scenario, a continuous stream of 350° F. of hot water was injected at a rate of 2,000 bbl/D into the formation water zone. Hot water injection has two purposes. Firstly, it raises the oil temperature; thus, it decreases its viscosity. Secondly, it displaces the oil. The targeted 50,000 STB/D total production rate plateau was sustained for 8.5 years and 12 years for the 75 and 100 wells cases, respectively.

Figure 5:
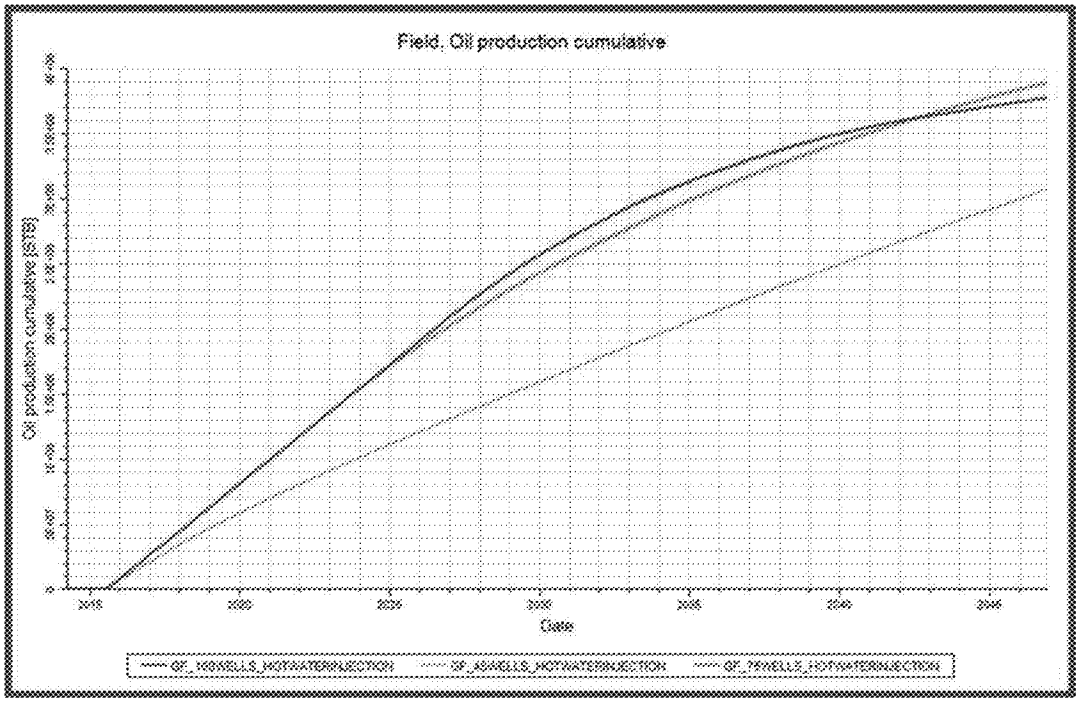
FIG. 5 is a chart comparing the cumulative oil production as a function of time for 45 wells, 75 wells, and 100 wells as estimated by Eclipse 100 software in a computer simulation of the hot water injection scenario.

FIG. 5 shows how the cumulative oil production increases due to hot water injection. The cumulative oil production obtained from the 45 wells, 75 wells, and 100 wells is 307 MMSTB, 390 MMSTB, and 378 MMSTB, respectively. It can be concluded from the cumulative production difference between the 75 wells and the 100 wells cases that the early quick reservoir depletion resulting from the 100 wells case could negatively affect the oil recovery at a later stage through the reservoir life.

It can be concluded from all the results presented thus far that the 75 producing wells case delivers the highest cumulative oil volume recovered. Thus, there is no need to consider the 100 wells case in the next scenarios, as it leads to additional drilling cost without significant incremental revenue gain compared to the 75 wells case. Consequently, the 75 producing wells case can be considered as the best optimum case, and it will be adopted for running further simulation recovery scenarios.

Example 5

Huff-and-Puff Scenario

Huff-and-puff projects have been applied over the last thirty years as an enhanced oil recovery process for heavy oil production. The huff-and-puff technique increases heavy oil recovery, as it decreases the oil viscosity and removes the near wellbore damage (skin). Theoretically, the huff-and-puff mechanism produces around 20-25% of the initial oil-in-place.

Figure 6:
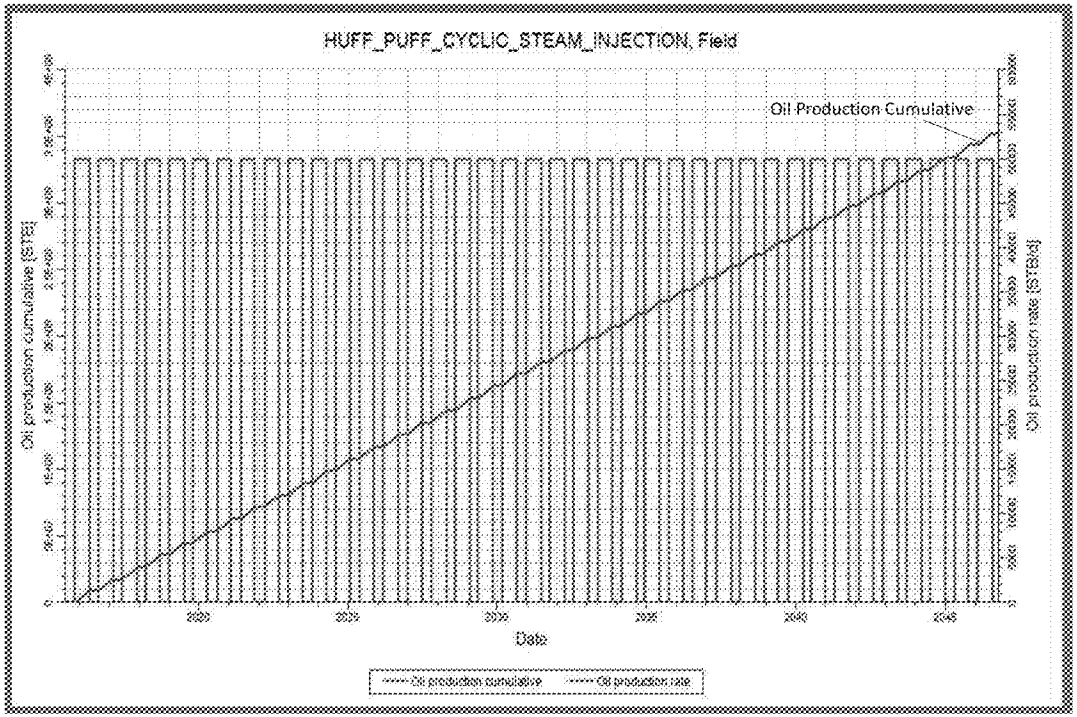
FIG. 6 is a chart of the daily and cumulative oil production versus time of the Gold Field as estimated by Eclipse 100 software in a computer simulation of the huff-and-puff scenario.

The huff-and-puff EOR technique consists of three main stages. The first stage consists of steam pressurizing and injection. In this stage, the oil is heated by the pressurized steam. This stage lasts for three months. The second stage involves heat soaking into the reservoir. This stage requires shutting-in the well for around three weeks. The third stage consists of oil production for six months per cycle. This cycle is repeated throughout the huff-and-puff process to ensure that the reservoir heat is maintained and hence the oil production rate does not decrease. FIG. 6 displays the total daily oil production rate and the cumulative production profiles of the huff-and-puff scenario. The cumulative oil production of this scenario is 358 MMSTB.

Example 6

Continuous Steam Injection Scenario

Figure 7:
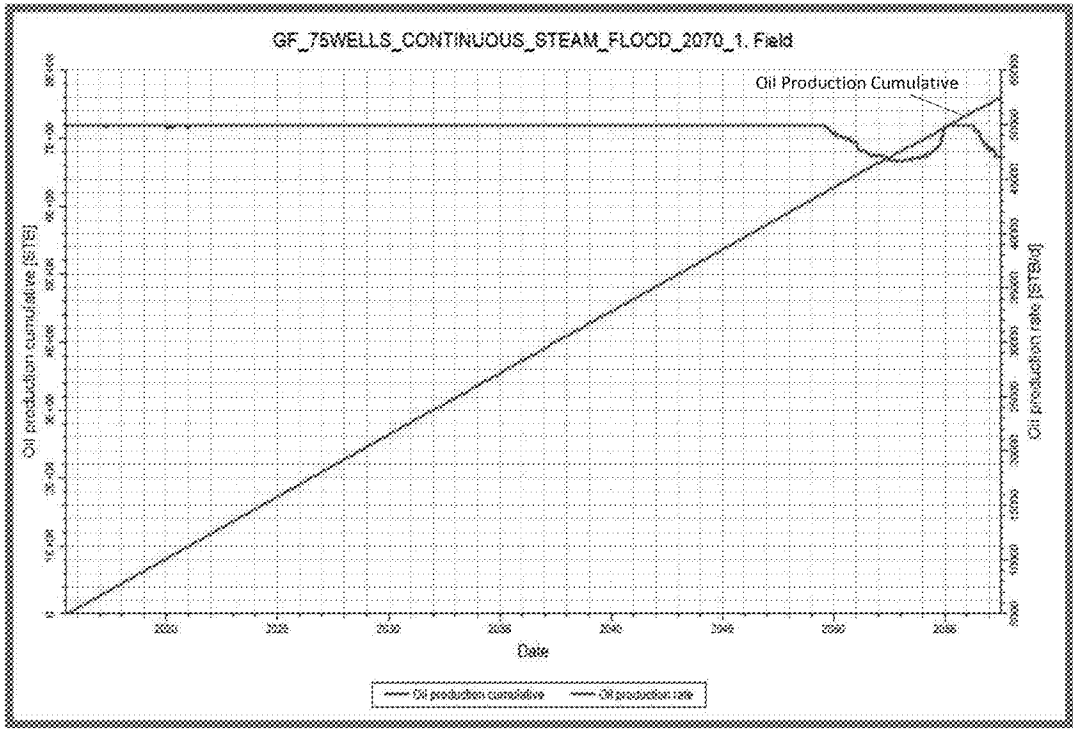
FIG. 7 is a chart of the daily and cumulative oil production versus time of the Gold Field as estimated by Eclipse 300 software in a computer simulation of the continuous steam injection scenario.

The continuous steam injection approach was adopted as a thermal EOR method that enhances oil production. Steam is continuously injected in 13 injection wells for the purpose of decreasing the heavy oil viscosity through heating. The continuous steam injection scenario was applied to the 75 production wells case. The responses from the continuous steam injection method were encouraging. The results obtained from the 75 wells are illustrated in FIG. 7. As can be observed from this Figure, the total daily oil production rate of 50,000 STB/D was sustained for a plateau length of about 50 years before declining. The cumulative oil recovery after 42 years of production was 571 MMSTB. The continuous steam injection scenario was generated using the thermal compositional model and was run in Eclipse 300.

Example 7

Mixed Steam-Polymer Injection Scenario

Figure 8:
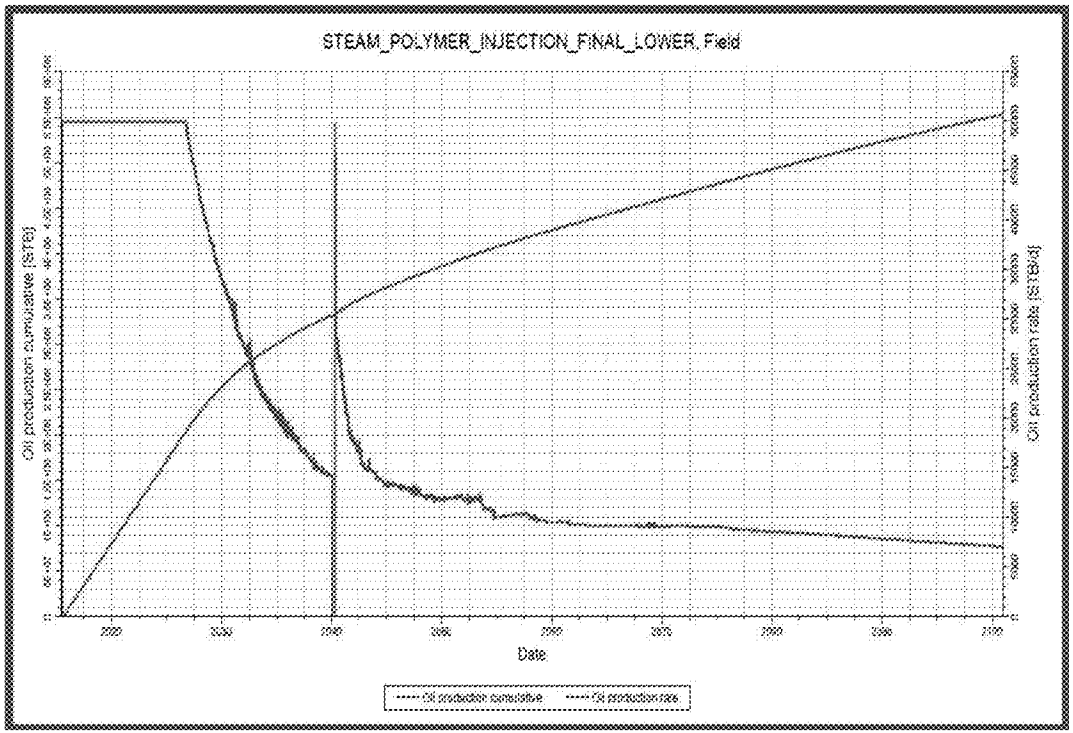
FIG. 8 is a chart of the daily and cumulative oil production versus time of the Gold Field as estimated by Eclipse 300 software in a computer simulation of the steam polymer injection scenario.

A mixed injection scenario was designed for stimulating the reservoir production rate. This scenario was developed such that a proper polymer stream that suits the formation oil type and properties is injected to provide a good sweep efficiency of the formation hydrocarbons. A continuous steam stream is injected into the water zone of the formation in order to heat the heavy oil and decrease its high viscosity. The steam was followed by a properly designed polymer solution. The steam was injected for the first twenty five years; then, the polymer solution was injected for around ten years. The results obtained from this scenario are illustrated in FIG. 8. The targeted total daily production rate was sustained during the first 13 years of the steam injection, after which it was observed to sharply decrease, yet to sustain a total daily production rate of around 7200 STB/D. It is clear that polymer injection had no added value to this scenario in terms of production rate sustainability. The cumulative oil production of this scenario is 375 MMSTB.

Example 8

Cyclic Steam Polymer Injection Scenario

Figure 32:
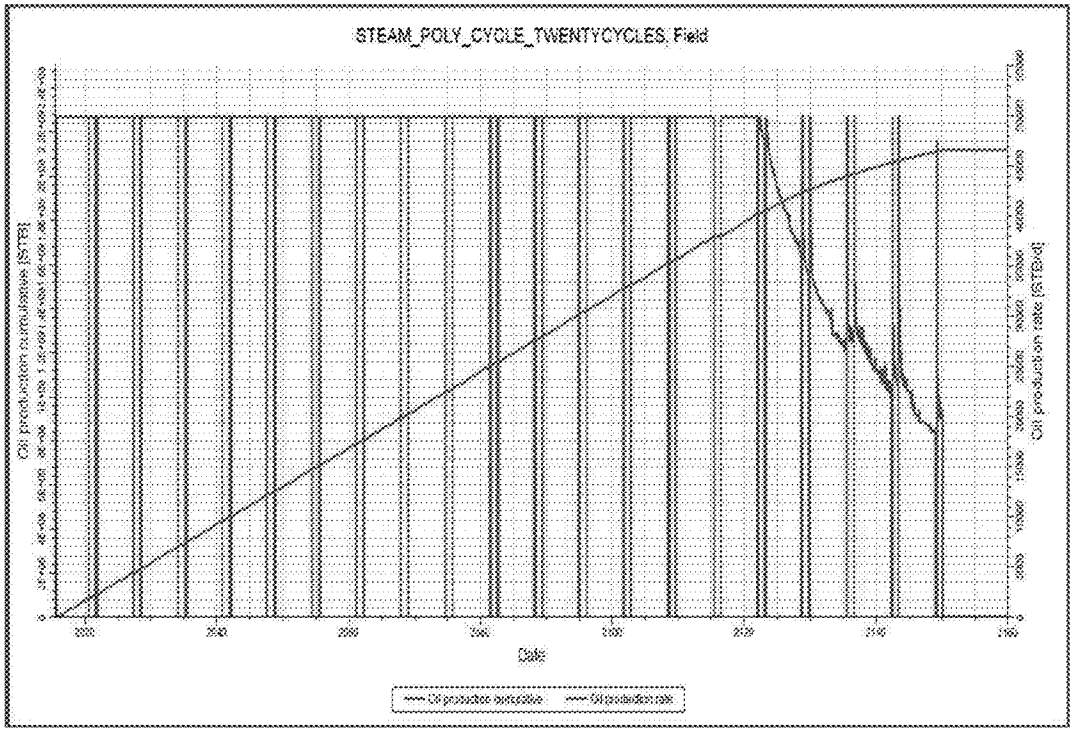
FIG. 32 is a plot of the daily and cumulative oil production of the Gold Field reservoir in Kuwait over the life of the reservoir in a simulation applying the cyclic steam polymer injection scenario.

In this scenario, the steam was injected first, soaked, and then followed by polymer injection. This cycle was repeated for three times during the reservoir study years. The best oil production and recovery was reached when applying the steam polymer cyclic injection scenario. This can be explained as follows. The first years of steam injection heated the oil and decreased its high viscosity. Then, the wells were shut down for a period of three months, giving the steam a suitable soaking period. Finally, a viscous polymer concentration of 0.7 Ib/STB was injected for the sake of displacing the heated oil to the production wells. The cyclic design of this scenario has delayed the production rate drop. The production profile of this scenario is as illustrated in FIG. 32. The cumulative oil production of this scenario is 550 MMSTB.

Example 9

Horizontal Wells Effect Scenario

An important point that needs to be investigated is the added value of drilling a horizontal well as a replacement for a vertical well. Horizontal wells are generally more preferable than vertical wells in shallow, clastic reservoirs. In fact, a horizontal well usually delivers twice the oil production of an equivalent vertical well. Replacing a vertical well by a horizontal well would increase the production rate due to increased exposure of the wellbore area of the horizontal well with the productive pay zone. Furthermore, water breakthrough is delayed in horizontal wells due to reduced drawdown, especially when the oil/water contact (OWC) is reasonably away from the reservoir zone of interest. Moreover, horizontal wells are useful for reaching areas with restrictions, such as farms and offshore locations. However, sand blocking issues are maximized in horizontal wells compared to vertical wells. Generally speaking, horizontal wells are more efficient than vertical wells if the by-passed oil lies in a horizontal pattern.

Figure 33:
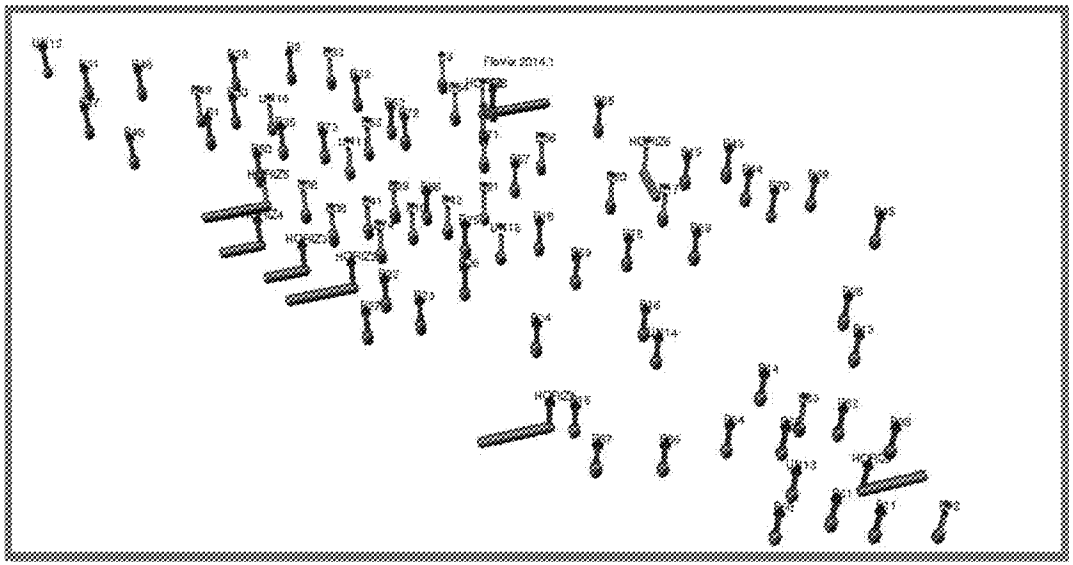
FIG. 33 is a map produced by Flo-Viz software showing the distribution of 75 total wells in the Gold Field reservoir in Kuwait after replacing 8 vertical wells with an equivalent number of horizontal wells to test the effect of horizontal wells.

In this study, a scenario has been generated by replacing 8 vertical wells with 8 horizontal wells. The location and number of horizontal wells were based on the oil accumulation and geological features of the reservoir. The horizontal-vertical wells scenario was compared to the 75 vertical wells of the base case. FIG. 33 shows the wells distribution, including the recently added 8 horizontal wells.

Figure 34:
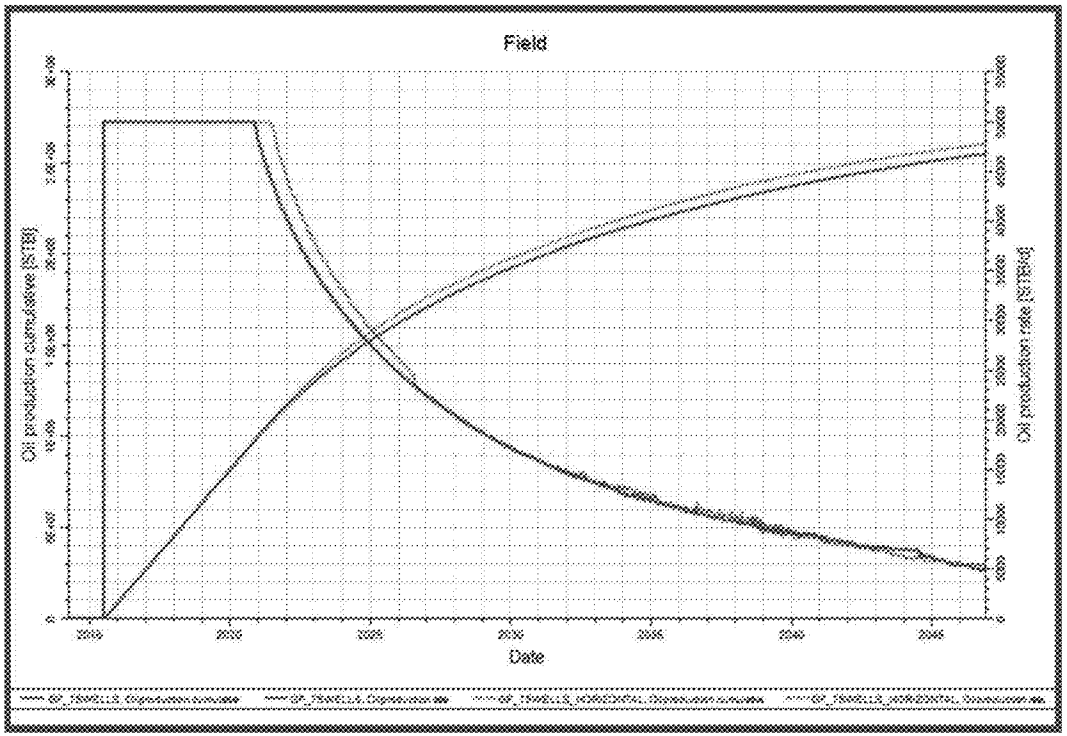
FIG. 34 is a plot simulating daily and cumulative oil production obtained from the 75 vertical and horizontal wells distributed as shown in FIG. 33.

FIG. 34 illustrates the results obtained from this scenario. The Figure indicates a slight incremental increase in the field cumulative oil production when using the horizontal-vertical wells combination scenario over the only vertical wells scenario. This gives an indication on how the oil production improvement would be for a larger scale, i.e., for a greater number of horizontal wells replacing vertical wells. FIG. 34 also shows that the total daily production plateau of this scenario is longer than the fully vertical wells by about 6 months. The cumulative oil production of this scenario is 261 MMSTB.

Table 2 presents the results of the various recovery scenarios compared in terms of cumulative oil recovery obtained from each scenario. As illustrated in the table, only 75 production wells were used for scenarios in Examples 5-9, since it was more economical than the other scenarios, as described above. The continuous steam injection scenario (Example 6) yields the highest cumulative oil production (571 MMSTB).

TABLE 2

Summary of Cumulative Oil Production at year 2046

| | | Cumulative Oil Production (MMSTB) | | |
|---|---|---|---|---|
| Example | Scenario | 45 Wells | 75 Wells | 100 Wells |
| 1 | Base | 204 | 255 | 271 |
| 2 | Water Injection | 275 | 328 | 341 |
| 3 | Polymer Injection | 305 | 386 | 400 |
| 4 | Hot Water Injection | 307 | 390 | 378 |
| 5 | Huff-and-Puff Continuous Steam | — | 358 | — |

TABLE 2-continued

Summary of Cumulative Oil Production at year 2046

| | | Cumulative Oil Production (MMSTB) | | |
|---|---|---|---|---|
| Example | Scenario | 45 Wells | 75 Wells | 100 Wells |
| 6 | Injection | — | 571 | — |
| 7 | Mixed Steam Polymer Injection | — | 375 | — |
| 8 | Cyclic Steam Polymer Injection | — | 550 | — |
| 9 | Horizontal Wells Effect | — | 261 | — |

Table 3 presents the results of the various recovery scenarios compared in terms of oil recovery factor obtained from each scenario.

TABLE 3

Summary of Scenario Recovery Factors

| | | Recovery Factor (%) | | |
|---|---|---|---|---|
| Example | Scenario | 45 Wells | 75 Wells | 100 Wells |
| 1 | Base | 5.1 | 6.4 | 6.8 |
| 2 | Water Injection | 7.0 | 8.2 | 8.6 |
| 3 | Polymer Injection | 7.7 | 9.6 | 10.1 |
| 4 | Hot Water Injection | 7.7 | 9.7 | 9.5 |
| 5 | Huff-and-Puff | — | 9.0 | — |
| 6 | Continuous Steam Injection | — | 14.4 | — |
| 7 | Mixed Steam Polymer Injection | — | 9.5 | — |
| 8 | Cyclic Steam Polymer Injection | — | 13.9 | — |
| 9 | Horizontal Wells Effect | — | 6.6 | — |

Conducting economic analysis is the key to a successful investment in a project. Many main parameters are computed in the economic study to reach an improved decision to be made.

The net income, also called the revenue; which is the total amount of money added through selling goods or services, is calculated by multiplying the annual hydrocarbon production by the oil and gas prices in an oil industry project.

The total sum of the capital cost, operating costs, fabrication and installation pipe costs, the cost of injected water, heaters, steam, polymer, and other expenses must be subtracted from the total income to get the resulting Net Present Value (NPV). NPV constitutes the key factor of an economic analysis by which a project is either accepted or rejected. When the calculated NPV is positive, the project is said to be economically feasible; on the other hand, the project must be rejected if the calculated NPV is a negative sign because the project investment will result in a loss in this case.

In the oil industry's domain, the NPV is highly sensitive to fluctuation of the international market hydrocarbon prices. The NPV increases for raised prices and vice versa, which expresses a proportional relationship. In addition to selling prices; NPV is also sensitive to the type of oil to be extracted. For example; lifting unconventional heavy oil to the surface costs more in terms of lifting forces through secondary recovery, thermal tertiary recovery, coated pipes, and special surface facilities, which could altogether add to the expenses significantly in a manner that decreases the NPV correspondingly.

All the above-explained production forecast scenarios run in Petrel were reviewed concurrently with the economic analysis prior to the determination of the best optimum strategy to be chosen for the development of the Gold field. The final outcome of this study resulted in selecting the cyclic steam polymer injection scenario for enhanced oil recovery, as the latter has been proven to recover the highest oil volume with the greatest Net Present Value (NPV) result.

Table 4 shows the different development scenarios with the corresponding calculated NPV obtained from the 75 well case of each scenario.

TABLE 4

Summary of net present value for each scenario

| Example | Scenario | Net Present Value (MM$) |
|---|---|---|
| 1 | Base | 8,268 |
| 2 | Water Injection | 8,900 |
| 3 | Polymer Injection | 10,816 |
| 4 | Hot Water Injection | 10,216 |
| 5 | Huff-and-Puff | 4,361 |
| 6 | Continuous Steam Injection | 12,650 |
| 7 | Mixed Steam Polymer Injection | 10,037 |
| 8 | Cyclic Steam Polymer Injection | 12,725 |
| 9 | Horizontal Wells Effect | 8,507 |

Even though Tables 2 and 3 indicate that the continuous stream injection scenario yields the highest cumulative oil production (571 MMSTB) and the highest recovery factor (14.4%), the financial analysis of all scenarios prove that the operational cost plays a major role in selecting the most profitable scenario. It can be concluded that the cyclic steam polymer injection yielded the highest oil recovery with the most optimum calculated NPV. This is referred to the powerful effect of the two injected fluids. Based on these considerations, the cyclic stream polymer injection scenario should be adopted for the field development later on in the future life of the reservoir.

In conclusion, a full field study of the X-reservoir in the Gold field area is discussed, future performance scenarios were generated, and finally an economic study has been conducted for evaluating the different scenarios. The stratigraphy of the X-reservoir is a reflection of widespread fluvial/deltaic and shallow-marine deposition. World-wide experience from shallow heavy oil basins with similar depositional environments to that of the gold field were reviewed and learned from. Seismic interpretation, dynamic model validation, and selection of the best well location are the main challenges a reservoir simulator could face in the course of the full field study of an exploratory shallow heavy oil reservoir. The FFGM for the Gold field in the X-reservoir was constructed; its structure and stratigraphy were based on 3-D seismic data tied to wireline logs. Model property grids were constructed using lithofacies-guided reservoir property distribution. A FFRM was constructed to study the production performance of the field. Forecast runs were simulated with the development scenario of total daily production rate of 50,000 STB/D. Another main challenge was the absence of fluid flow and well performance of water layers near the oil-bearing intervals due to the lack of real historical production data. The lack of data availability and the limited number of available wells in the area made it risky at some points of the exploratory phase due to the lack of enough well control on the full field area. The dynamic model must be validated and tested for accuracy so that it can be taken as a confident guide to predict future field performance. Main recovery from heavy oil reservoirs come from applying EOR methods that target and decrease the residual oil. The EOR methods considered in this study are polymer injection, hot water injection, huff-and-puff, continuous steam injection, steam polymer injection, and cyclic steam polymer injection. Forecast runs for different EOR methods showed that the most optimum scenario that recovers a satisfactory amount of the IOIP and that is economically feasible was the 75 wells scenario with cyclic polymer and steam injection, since the added amount of recoverable oil by the 100 wells scenario was not sufficient for drilling the extra 25 wells.

It is to be understood that the method for enhancing shallow heavy oil reservoir production is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

I claim:

1. A method for enhancing shallow heavy oil reservoir production using cyclic steam polymer injection to recover oil from the reservoir, the method comprising the steps of:

(a) injecting steam into a shallow reservoir of heavy, viscous oil through an injection well, the reservoir having at least one production well;

(b) shutting down the wells for a period of time sufficient to allow the steam to soak into the reservoir and reduce the viscosity of the heavy oil in the reservoir, wherein the period of time is three months;

(c) then, opening the injection well and injecting a viscous polymer concentration into the reservoir to displace the oil to the at least one production well;

(d) opening the at least one production well and resuming production of oil from the reservoir; and (e) repeating a cycle defined by steps (a) through (d) as needed over a lifetime of the reservoir in order to maintain levels of production of oil from the reservoir.

2. The method for enhancing shallow heavy oil reservoir production according to claim 1, wherein said step of repeating a cycle defined by steps (a) through (d) as needed over a lifetime of the reservoir comprises repeating the cycle at least three times over the lifetime of the reservoir.

3. The method for enhancing shallow heavy oil reservoir production according to claim 1, wherein said step of then, opening the injection well and injecting a viscous polymer concentration into the reservoir to displace the oil to the at least one production well comprises injecting a viscous polymer concentration of 0.7 lb/STB into the reservoir.

* * * * *